US008950905B2

(12) United States Patent
Howe

(10) Patent No.: US 8,950,905 B2
(45) Date of Patent: Feb. 10, 2015

(54) OPTICAL FILM COMPRESSION LENSES, OVERLAYS AND ASSEMBLIES

(71) Applicant: Leslie David Howe, Atlanta, GA (US)

(72) Inventor: Leslie David Howe, Atlanta, GA (US)

(73) Assignee: Southpac Trust International, Inc., Rarotonga (CK), Trustee of the LDH Trust ( * ) Notice: Subject to any disclaimer, the term of this patent is extended or adjusted under 35 U.S.C. 154(b) by 0 days.

(21) Appl. No.: 14/267,940

(22) Filed: May 2, 2014

(65) Prior Publication Data

US 2014/0240980 A1 Aug. 28, 2014

Related U.S. Application Data

(63) Continuation-in-part of application No. 13/531,515, filed on Jul. 23, 2012, and a continuation-in-part of application No. 14/225,546, filed on Mar. 26, 2014, and a continuation-in-part of application No. 14/231,819, filed on Apr. 1, 2014, and a continuation-in-part of application No. PCT/US2013/039895, filed on May 7, 2013, and a continuation-in-part of application No. PCT/US2013/059919, filed on Sep. 16, 2013, and a (Continued)

(51) Int. Cl.

| | |
|---|---|
| ***F21V 5/00*** | (2006.01) |
| ***F21V 5/04*** | (2006.01) |
| ***F21V 3/04*** | (2006.01) |
| ***F21V 15/01*** | (2006.01) |
| ***F21V 17/10*** | (2006.01) |
| *F21Y 103/00* | (2006.01) |

(52) U.S. Cl.

CPC ... *F21V 5/04* (2013.01); *F21V 9/50* (2013.01); *F21V 3/0445* (2013.01); *F21V 5/004* (2013.01); *F21V 5/005* (2013.01); *F21V 15/01* (2013.01); *F21V 17/101* (2013.01); *F21V 17/107* (2013.01); *F21V 17/108* (2013.01); *F21Y 2103/00* (2013.01); *F21Y 2103/003* (2013.01)

USPC ..... 362/332; 362/320

(58) Field of Classification Search

USPC ..... 362/235, 249.06, 332, 320, 335, 334

See application file for complete search history.

(56) References Cited

U.S. PATENT DOCUMENTS

| | | | | |
|---|---|---|---|---|
| 8,011,805 | B2 * | 9/2011 | Chiang | 362/249.02 |
| 2009/0140271 | A1 * | 6/2009 | Sah | 257/88 |
| 2009/0161359 | A1 * | 6/2009 | Siemiet et al. | 362/235 |
| 2009/0219713 | A1 * | 9/2009 | Siemiet et al. | 362/218 |

*Primary Examiner* — Andrew Coughlin

(74) *Attorney, Agent, or Firm* — Troutman Sanders LLP; James E. Schutz; Mark Lehi Jones

(57) ABSTRACT

A compression lens assembly is disclosed that includes one or more pieces of optical film with a top edge defining an X-axis, a bottom edge, a left edge defining a Y-axis, a right edge at a distance W from the left edge, and a Z-axis perpendicular to the X- and Y-axes. One or more parallel inward and or outward folds extend between the top and bottom edges. The compression lens assembly may include a lens containment feature with top and bottom channels configured to engagingly secure and restrict the corresponding top and bottom edges of the film in at least the Z-axis direction, and left and right channels spaced a distance smaller than W and configured to compress the left and right film edges together and restrict film movement in the X-axis direction. The compressed film piece may form one or more hill or valley profiles between adjacent folds.

20 Claims, 27 Drawing Sheets

Related U.S. Application Data continuation-in-part of application No. 14/254,960, filed on Apr. 17, 2014, now Pat. No. 8,876,337.

(60) Provisional application No. 61/959,641, filed on Aug. 27, 2013, provisional application No. 61/963,037, filed on Nov. 19, 2013, provisional application No. 61/963,603, filed on Dec. 9, 2013, provisional application No. 61/963,725, filed on Dec. 13, 2013, provisional application No. 61/964,060, filed on Dec. 23, 2013, provisional application No. 61/964,422, filed on Jan. 6, 2014, provisional application No. 61/965,710, filed on Feb. 6, 2014, provisional application No. 61/958,559, filed on Jul. 30, 2013.

FIG 2A
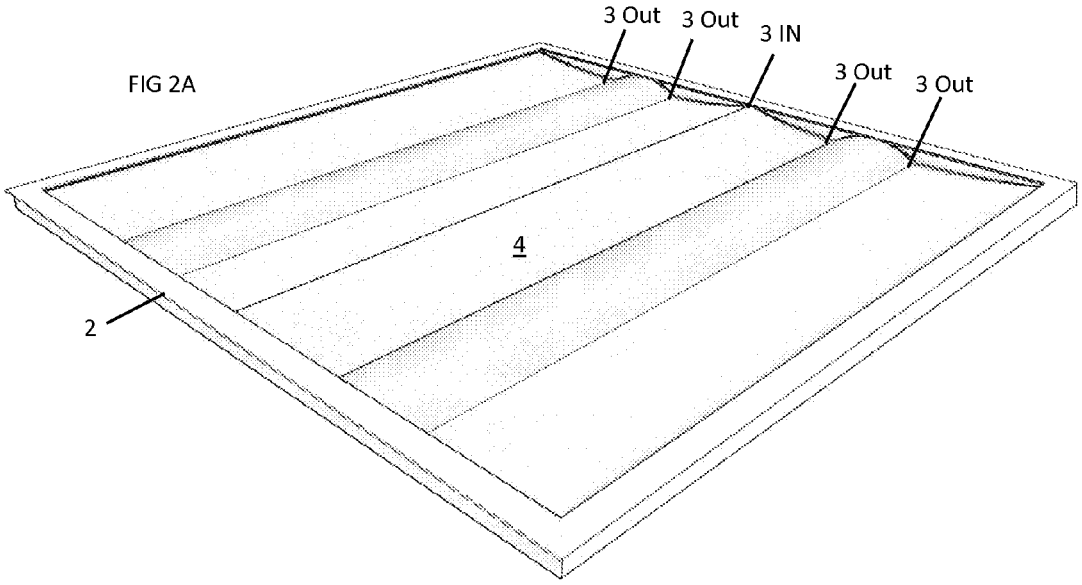
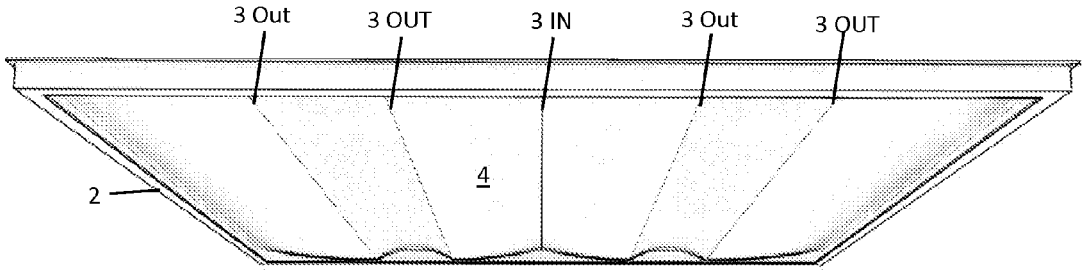
FIG 2B
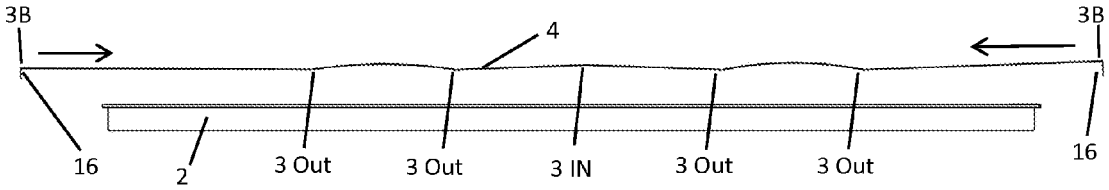
FIG 2C

FIG 3A
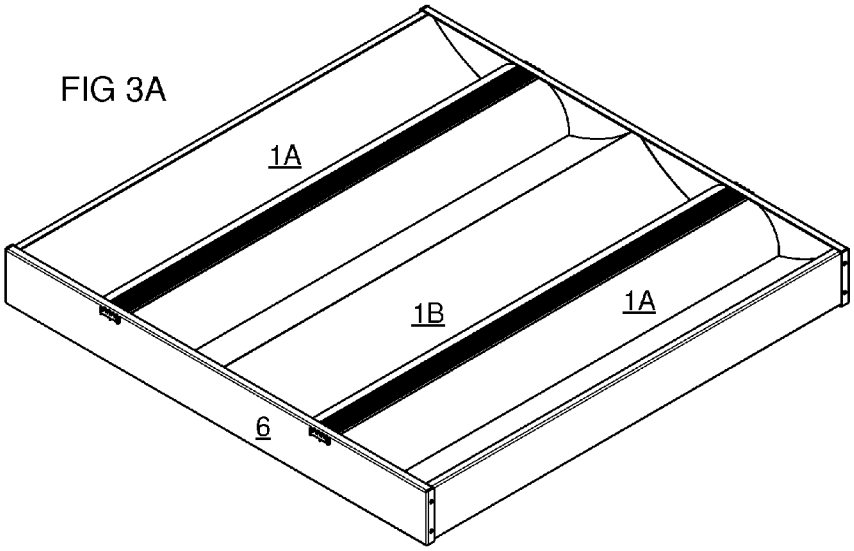
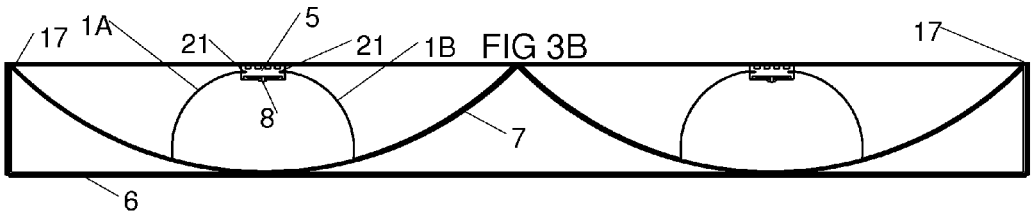
FIG 3B
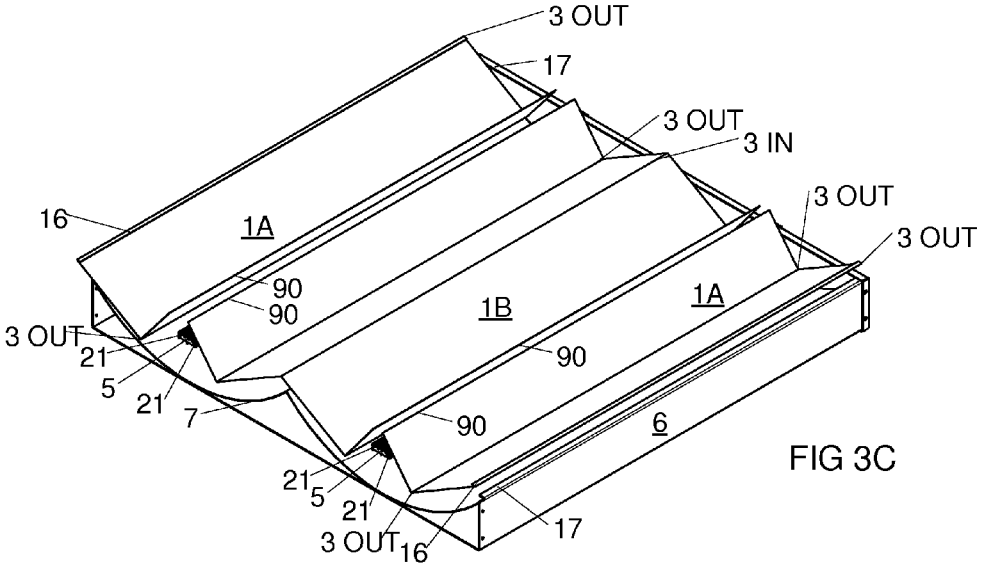
FIG 3C

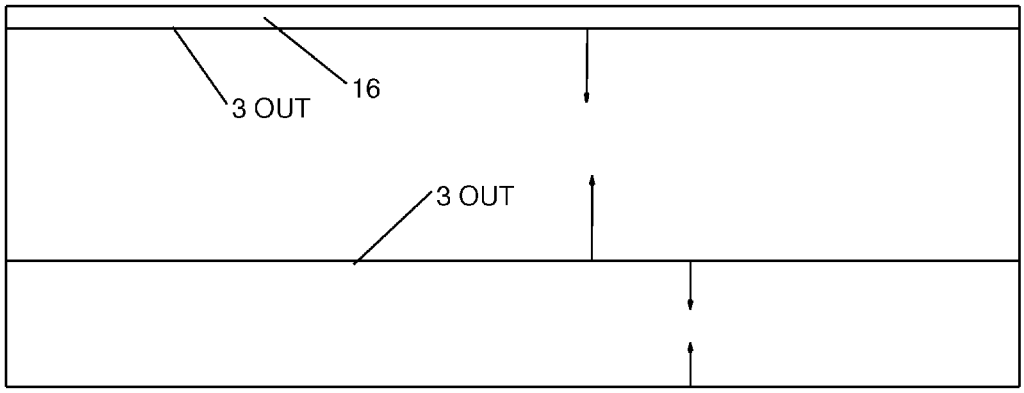
FIG 4A
FIG 4B
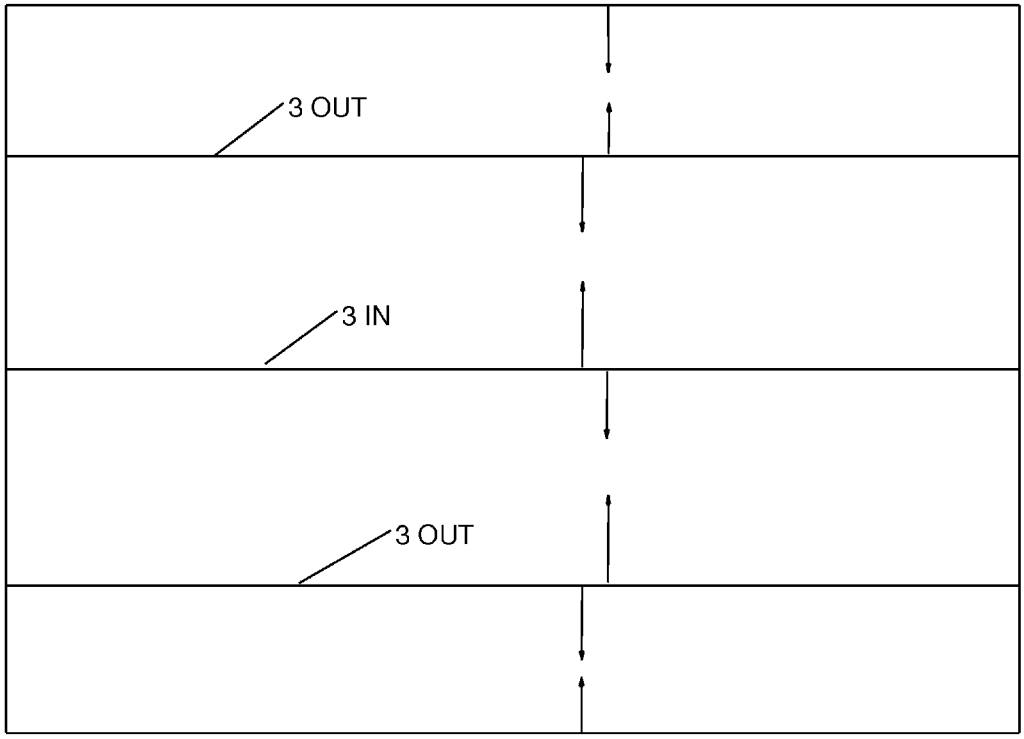

FIG 13A
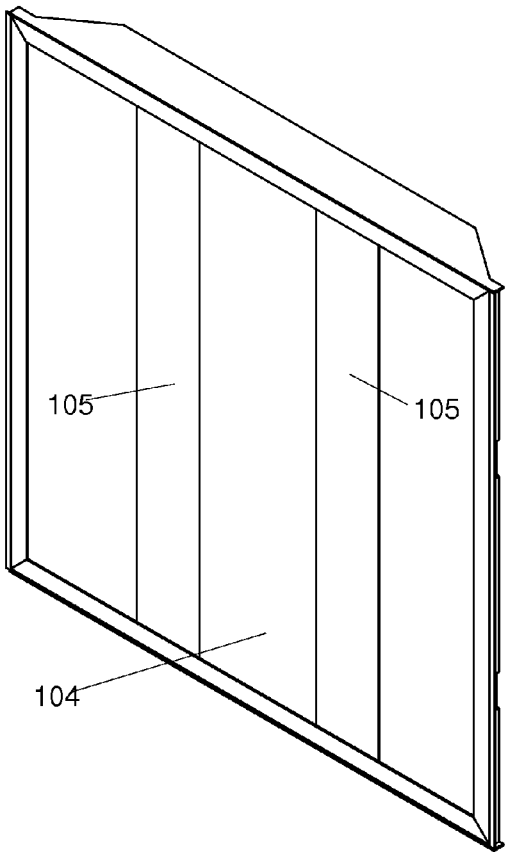
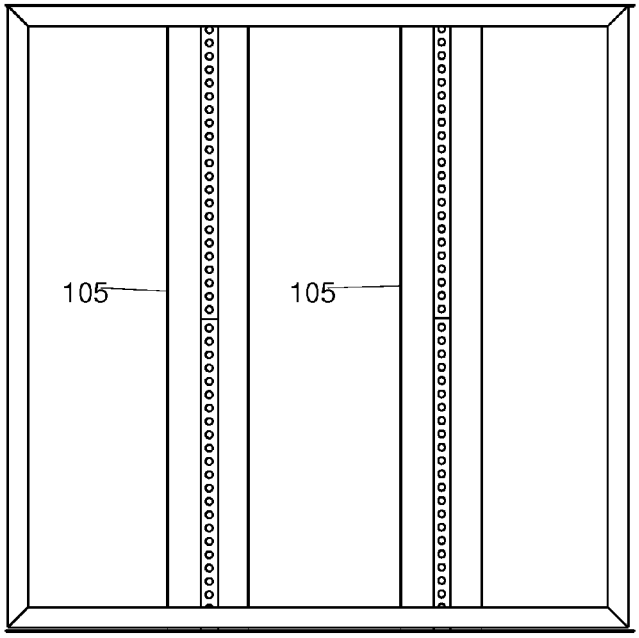
FIG 13B

FIG 14A
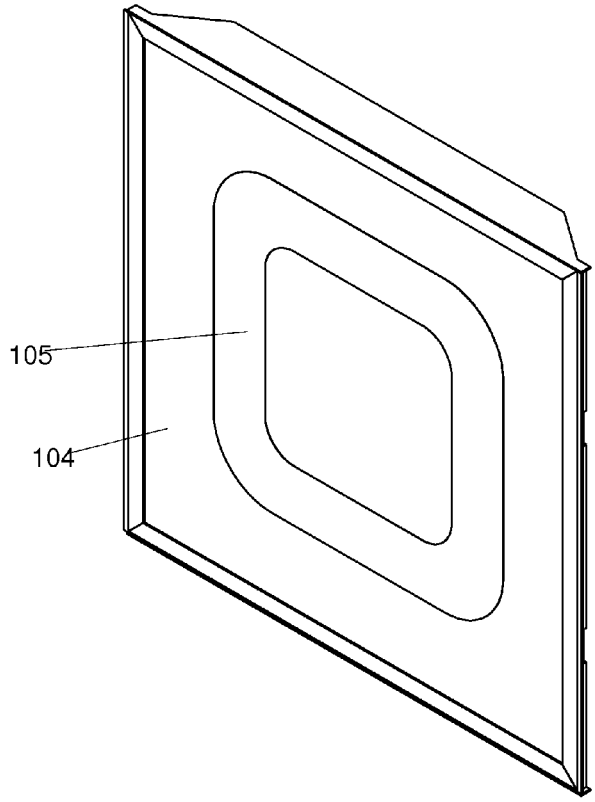
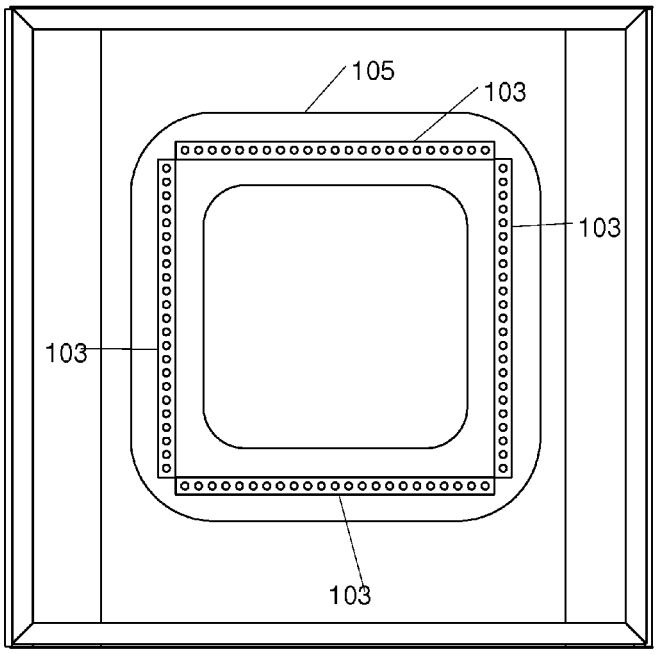
FIG 14B

FIG 16A
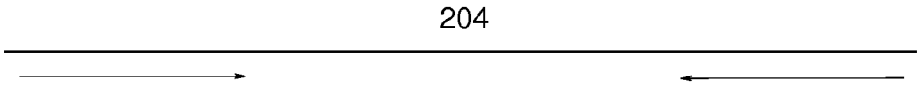
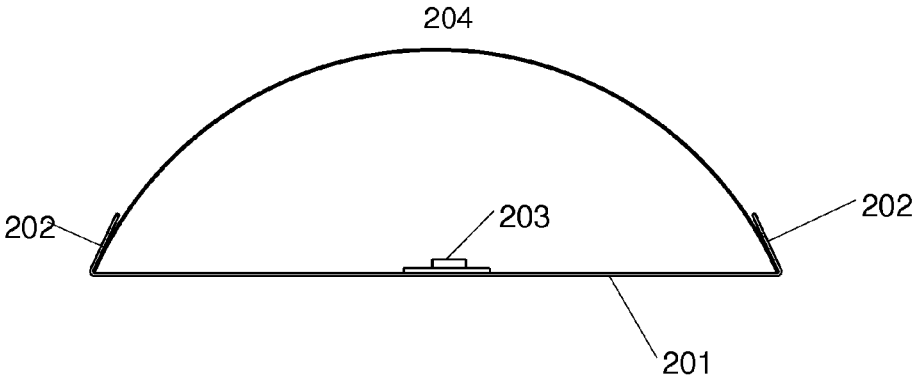
FIG 16B

OPTICAL FILM COMPRESSION LENSES, OVERLAYS AND ASSEMBLIES

RELATED APPLICATIONS

This application is a continuation-in-part of US Patent Publication No. US20120300471 A1 entitled "Light Diffusion and Condensing Fixture," filed Jul. 23, 2012; and also a continuation-in-part of U.S. patent application Ser. No. 14/225,546, entitled "Frameless Light Modifying Element," filed Mar. 26, 2014; and also a continuation-in-part of U.S. patent application Ser. No. 14/231,819, entitled "Light Modifying Elements," filed Apr. 1, 2014, and also a continuation-in-part of U.S. patent application Ser. No. 14/254,960, entitled "Light Fixtures and Multi-Plane Light Modifying Elements," filed Apr. 17, 2014; the contents of which are incorporated by reference in their entirety as if set forth in full. This application is also a continuation-in-part of PCT Application No. PCT/US2013/039895, entitled "Frameless Light Modifying Element," filed May 7, 2013; and is also a continuation-in-part of PCT Application No. PCT/US2013/059919, entitled "Light Modifying Elements," filed Sep. 16, 2013, the contents of which are also incorporated by reference in their entirety as if set forth in full.

This application also claims the benefit of the following United States Provisional Patent Applications, the contents of which are incorporated by reference in their entirety as if set forth in full: U.S. Provisional Patent Application No. 61/958,559, entitled "Hollow Truncated-Pyramid Shaped Light Modifying Element," filed Jul. 30, 2013; U.S. Provisional Patent Application No. 61/959,641 entitled "Light Modifying Elements," filed Aug. 27, 2013; U.S. Provisional Patent Application No. 61/963,037, entitled "Light Fixtures and Multi-Plane Light Modifying Elements," filed Nov. 19, 2013; U.S. Provisional Patent Application No. 61/963,603, entitled "LED Module," filed Dec. 9, 2013; U.S. Provisional Patent Application No. 61/963,725, entitled "LED Module and Inner Lens System," filed Dec. 13, 2013; U.S. Provisional Patent Application No. 61/964,060, entitled "LED Luminaire, LED Mounting Method, and Lens Overlay," filed Dec. 23, 2013; U.S. Provisional Patent Application No. 61/964,422, entitled "LED Light Emitting Device, Lens, and Lens-Partitioning Device," filed Jan. 6, 2014; and U.S. Provisional Patent Application No. 61/965,710, entitled "Compression Lenses, Compression Reflectors and LED Luminaires Incorporating the Same," filed Feb. 6, 2014.

TECHNICAL FIELD

This invention generally relates to lighting, light fixtures and lenses.

BACKGROUND

There is a continuing need for low cost systems that can improve the light quality and visual aesthetics of light fixtures using LED light sources.

BRIEF SUMMARY

In an example first embodiment of the technology, a light emitting device may comprise an enclosure having an inner back surface with four or more LED arrays mounted to the inner back surface of the enclosure. Each LED array may comprise a first end and a second end, an elongated rectangular shape, and one or more linear rows of LEDs. The first end or the second end of each LED array may be disposed in proximity to a first end or a second end of an adjacent LED array, wherein the four or more LED arrays may be mounted to form an acute angle of between about 60 degrees and about 120 degrees between adjacent LED arrays.

In an example second embodiment, a lens assembly may comprise a lens element configured to modify light from a light source, and one or more lens-partitioning elements disposed on at least one surface of the lens element. The one or more lens-partitioning elements may comprise one or more pieces of optical film or one or more layers or groupings of particles, wherein the one or more pieces of optical film or the one or more layers or groupings of particles may be arranged in a two-dimensional geometric shape on the lens element.

In an example third implementation of the disclosed technology, a compression lens assembly may comprise at least one piece of optical film. The at least one piece of optical film may comprise a left edge defining a Y-axis, a right edge that is substantially parallel to the left edge, a top edge defining a X-axis and having an uncompressed edge length UEL, a bottom edge that is substantially parallel to the top edge and having an uncompressed edge length about UEL. The at least one piece of optical film may further comprise a Z-axis that is perpendicular to the X-axis and the Y-axis, a top light-emitting side and a bottom light-receiving side, and one or more inward folds and or one or more outward folds extending from the top edge to the bottom edge, wherein the one or more folds may be substantially parallel to one or more of the left edge and the right edge.

The compression lens assembly of the third example embodiment may further comprise an edge truss on each of the left edge and the right edge, wherein each edge truss may comprise at least one truss side configured from a corresponding fold in the at least one piece of optical film. The at least one truss side of each of each edge truss may be configured at an angle relative to the top light emitting side of the at least one piece of optical film and may be configured to resist deflection of each edge truss.

The compression lens assembly of the third example embodiment may also further comprise a lens containment feature that may comprise a top channel and a bottom channel having channel lengths CL smaller than the uncompressed edge length UEL of the top and bottom edges of the at least one piece of optical film. The top channel and bottom channel may be configured to engagingly secure and restrict movement of the corresponding top and bottom edges of the at least one piece of optical film in at least the Z-axis direction.

The compression lens assembly of the third example embodiment may also further comprise may a lens containment feature that may comprise a left channel and a right channel configured to slidingly accept in a Y-axis direction at least a portion of the at least one piece of optical film at the corresponding left and right edges, and to engagingly restrict movement and to compress in an X-axis direction at least a portion of the at least one piece of optical film. The at least one piece of optical film under compression may form one or more hill or valley profiles between adjacent folds.

In a fourth example embodiment, a retrofit lighting module may comprise an elongated rectangular piece of thermally conductive material comprising two long edges separated by a width W1, two short edges, and a front surface. Each long edge may comprise a mounting flange extending along all or a substantial portion of the length of the edge, and wherein each mounting flange may form an angle of less than about 90 degrees with the front surface. The retrofit lighting module may further comprise an elongated rectangular piece of optical film having width W2 that is greater than width W1. The piece of optical film may comprise two short film edges and two long film edges, wherein the optical film piece may be configured to form a curved lens when the two long film edges are compressed towards each other and inserted into and between the corresponding flanges on the elongated rectangular piece of thermally conductive material. The front surface of the thermally conductive piece may be configured for attachment to one or more linear LED arrays, and the retrofit lighting module may be configured to retrofit into a lighting fixture.

BRIEF DESCRIPTION OF THE FIGURES

FIG. 1F-2 depicts a profile view of an example embodiment of compression lens mounted in a luminaire doorframe, wherein the top frame member of the doorframe has been removed and various lens planes have been indicated.

FIG. 1F-3 depicts a perspective view of an example embodiment of compression lens in an uncompressed state.

FIG. 2A depicts a perspective view of an example embodiment of compression lens mounted in a luminaire doorframe.

FIG. 2B depicts an underneath perspective view of the example embodiment of compression lens mounted in a luminaire doorframe as shown in FIG. 2A.

FIG. 2C depicts an exploded side view of the example embodiment of compression lens mounted in a luminaire doorframe as shown in FIG. 2A, wherein the lens is in an uncompressed state.

FIG. 3A depicts a perspective view of an example embodiment of luminaire, compression reflector, and compression lens.

FIG. 3B depicts a side cutaway view of the example embodiment of luminaire, compression reflector, and compression lens shown in FIG. 3A.

FIG. 3C depicts a perspective exploded cutaway view of the example embodiment of luminaire, compression reflector, and compression lens shown in FIG. 3A.

FIG. 4A depicts a flat pattern cutting and scoring template of an example embodiment of lens section depicted in FIG. 3A.

FIG. 4B depicts another flat pattern of another example embodiment of lens section depicted in FIG. 3A.

FIG. 13A depicts a perspective view of a lens mounted in a doorframe on a troffer light fixture with an example embodiment of linear lens-partitioning elements mounted on the lens's surface.

FIG. 13B depicts a front view of an example embodiment of linear lens-partitioning elements mounted on a lens attached to an example embodiment of LED fixture with two linear LED arrays mounted parallel to each other. The lens has been shown as transparent to show the placement of the LED arrays, and the lens-partitioning elements have been made translucent for illustrative purposes.

FIG. 14A depicts a perspective view of a lens mounted in a doorframe on a troffer light fixture with an example embodiment of linear lens-partitioning element mounted on the lens's surface.

FIG. 14B depicts a front view of an example embodiment of lens-partitioning element mounted on a lens attached to an example embodiment of LED light fixture with LED arrays mounted in a square pattern. The lens has been shown as transparent to show the placement of the LED arrays.

FIG. 16A depicts a side view of a piece of optical film.

FIG. 16B depicts a side view of an example embodiment of light module with the optical film piece from FIG. 16A compressed and inserted to form a curved lens.

DETAILED DESCRIPTION

Embodiments will be described more fully hereinafter with reference to the accompanying drawings, in which example embodiments are shown. The disclosed technology may, however, be embodied in many different forms and should not be construed as limited to the embodiments set forth herein; rather, these embodiments are provided so that this disclosure will be thorough and complete, and will fully convey the scope of the embodiments to those skilled in the art.

It should be clearly understood that the embodiments described herein are examples, and may be adapted for use with many different designs and configurations including, but not limited to: different dimensions, different optical film configurations, different mounting configurations, different fabrication materials, different light fixture enclosures etc.

Various methods, concepts, designs, and parts may be combined to produce desired operating specifications of light fixtures, optical film compression lenses, compression reflectors, lenses with geometric overlays, light modules etc., and will be described with reference to the accompanying figures. However, this should in no way limit the scope of each individual example embodiments.

For brevity, elements, principals, methods, materials or details in example embodiments that are similar to, or correspond to elements, principals, methods, material or details elsewhere in other example embodiments in this application, or related applications, may or may not be repeated in whole or in part, and should be deemed to be hereby included in the applicable example embodiment.

Figure 1A:
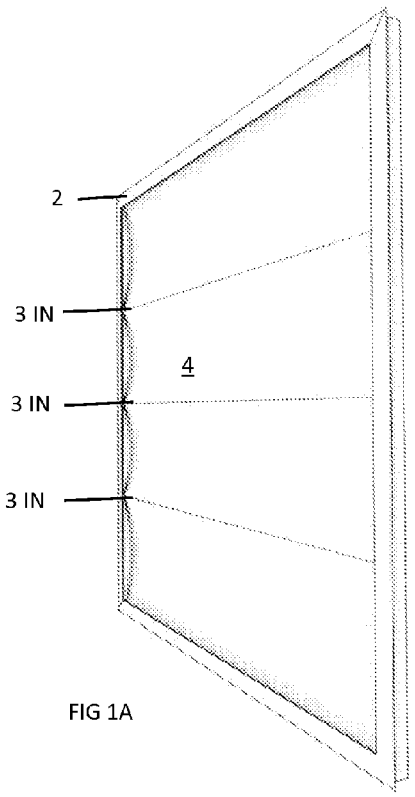
FIG. 1A depicts a perspective view of an example embodiment of compression lens mounted in a luminaire doorframe.
Figure 1B:
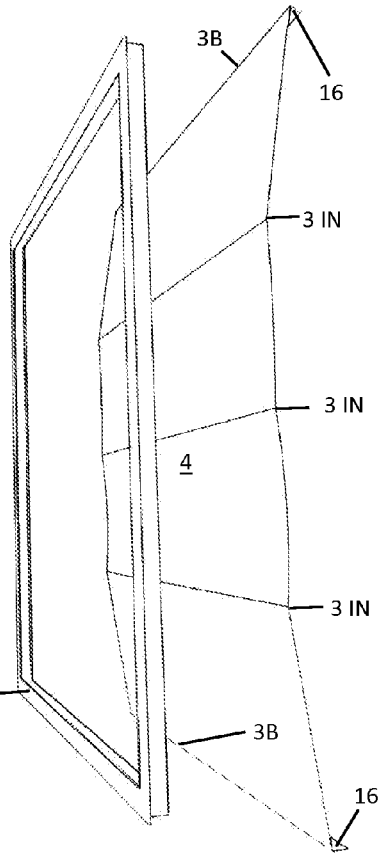
FIG. 1B depicts an exploded perspective view of the example embodiment of compression lens shown in FIG. 1A, wherein the lens is in an uncompressed state.
Figure 1C:
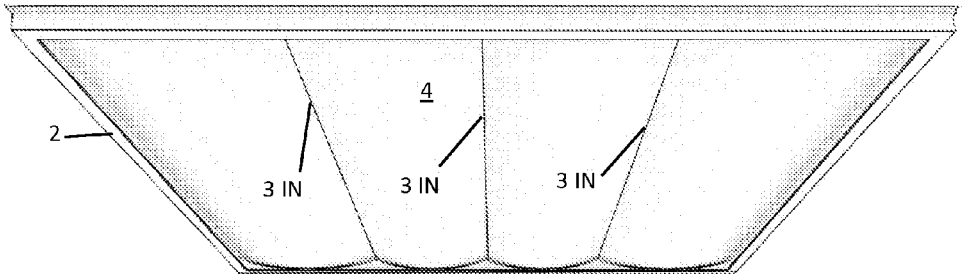
FIG. 1C depicts an underneath perspective view of the example embodiment of compression lens mounted in a luminaire doorframe shown in FIG. 1A.
Figure 1D:
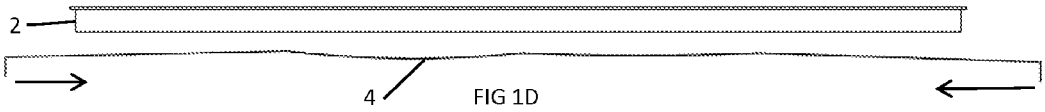
FIG. 1D depicts an exploded side view of the example embodiment of compression lens mounted in a luminaire doorframe shown in FIG. 1A, wherein the lens is in an uncompressed state.
Figure 1E:
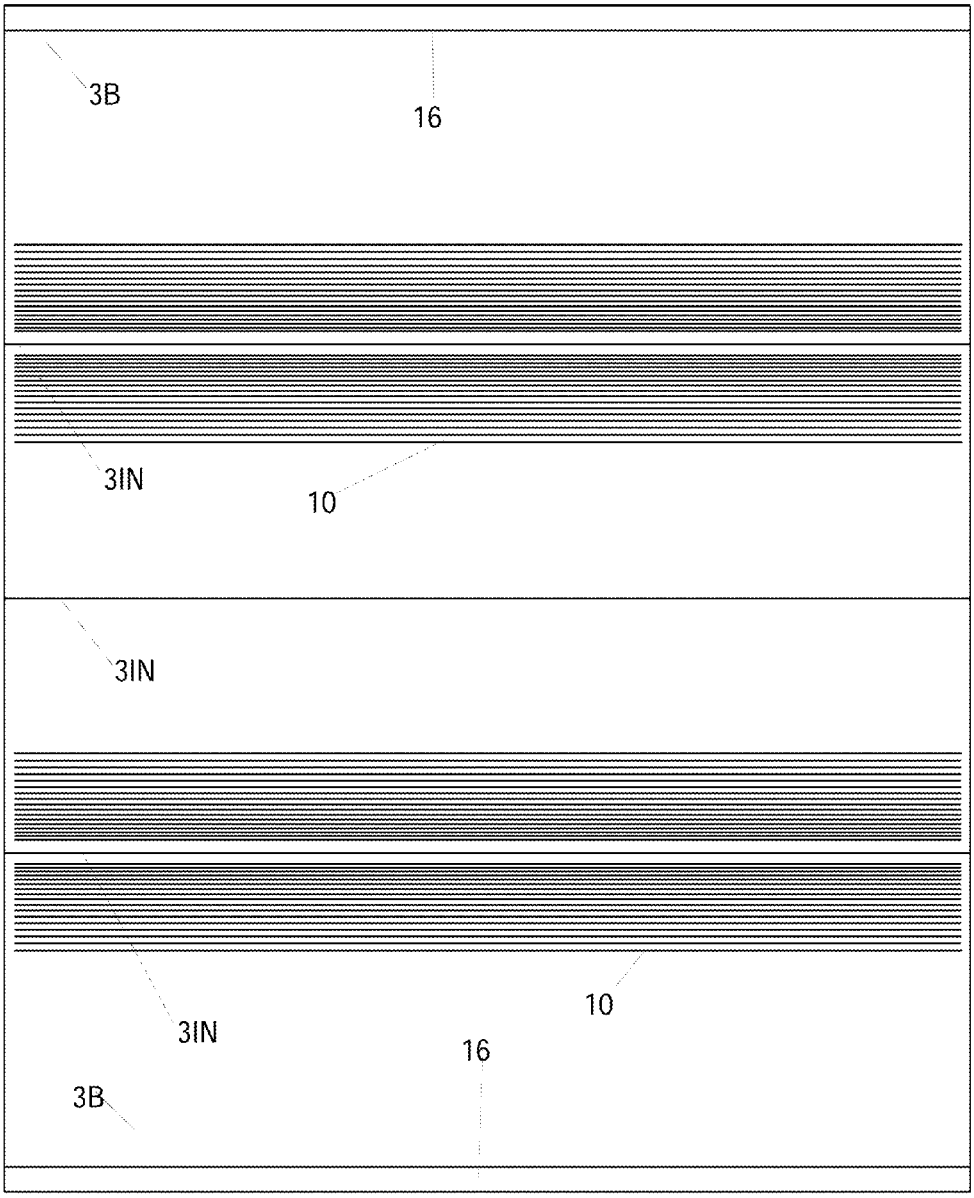
FIG. 1E depicts a flat pattern cutting and scoring template of the lens depicted in FIG. 1A, and includes linear refraction features.

In a related Patent Application PCT/US2013/059919 entitled "Frameless Light Modifying Element" filed Sep. 16, 2013 (incorporated by reference, and for which the present application claims priority), an example embodiment of curved optical film lens is disclosed. FIG. 1G depicts an uncompressed optical film lens 4X according to an example implementation. In one example implementation, the uncompressed optical film lens 4X may include edge trusses 16 created from corresponding folds along two opposing edges of optical film pieces of the lens 4X. When lateral compression force is applied to the two opposing edges in the general direction of the arrows on the uncompressed lenses 4X, a compressed lens 4 may result. In an example implementation, this compressed lens 4 may be attached to example mounting features 14 on an example luminaire as shown. Accordingly, the shape of each compressed lens 4 may be limited by the two opposing attachment points 14 along with the dimensional configuration and flexibility of the optical film material. Although an example embodiment of lens as described may be advantageous for many luminaire applications, it may have limitations for certain luminaire applications due to its general architecture.

As previously described in related applications (also incorporated by reference, and for which the present application claims priority), a fold may be created in a piece of optical film by creating a score line first, and subsequently folding along the score line, may be created using mechanical creasing machines or mechanical folding machines such as knife or plow folders etc. Regardless of the method of creating a fold, folds may be created along fold lines wherein the film sections on either side of the fold line may be folded inwards (away from the front light-emitting side of the film) or outwards (towards the front light-emitting side of the film). When folded inwards, the apex or peak of the fold may be disposed of the front side of the film, and when folded outwards, the peak of the fold may be disposed on the light-receiving side of the film. The orientation of the fold as described may determine the ultimate direction the film sections on either side of the fold may be predisposed to fold in when the optical film is subjected to lateral compression forces.

Figure 1F:
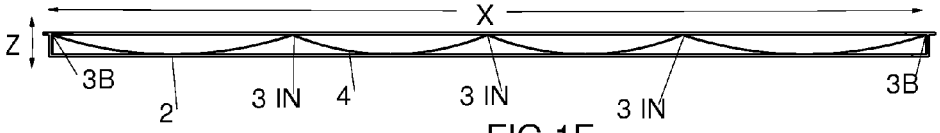
FIG. 1F depicts a side cutaway view of the example embodiment of compression lens mounted in a luminaire doorframe.
Figures 1, 1F, 2:
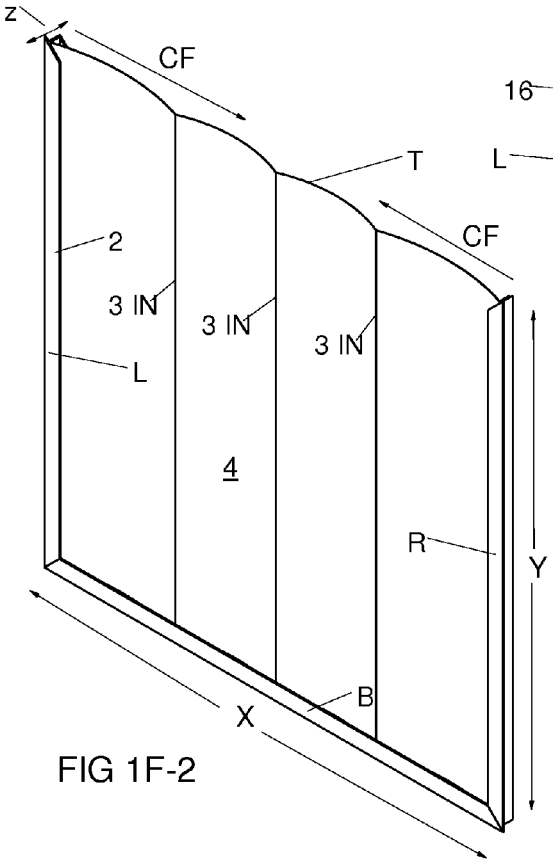
Figures 1, 1F, 2, 3:
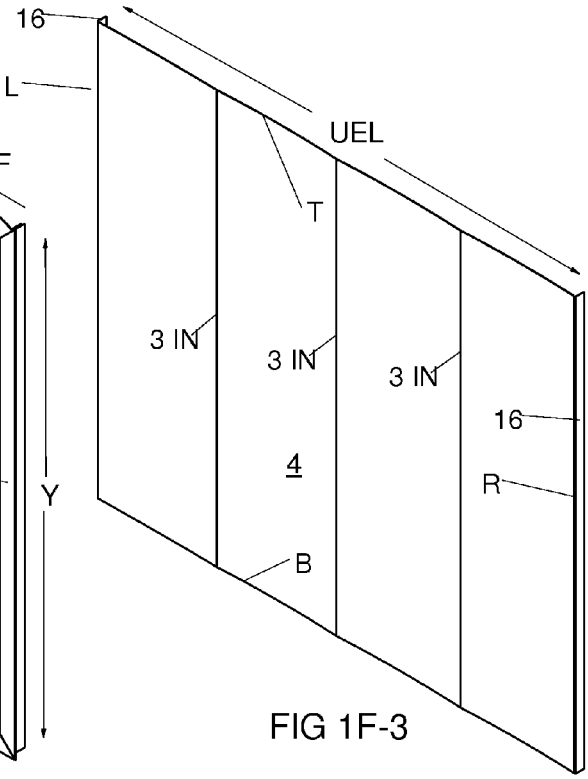
Figure 1G:
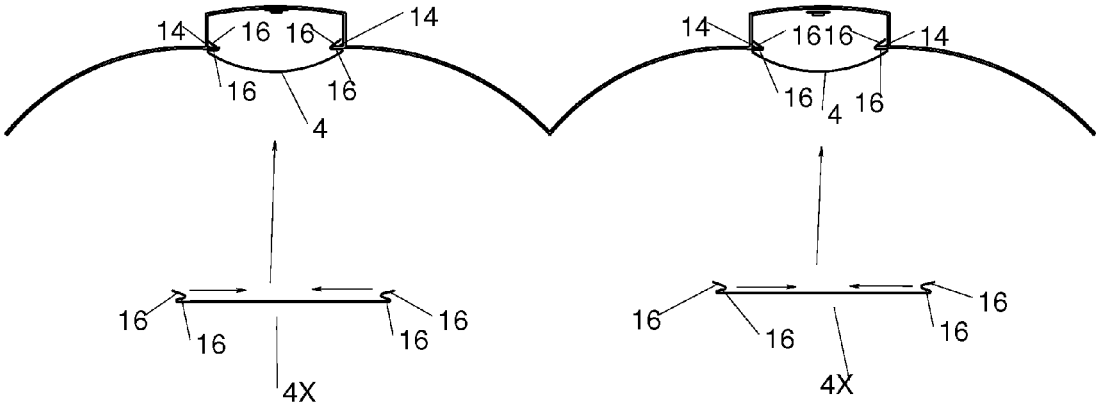
FIG. 1G depicts a compression lens.
Figure 1H:
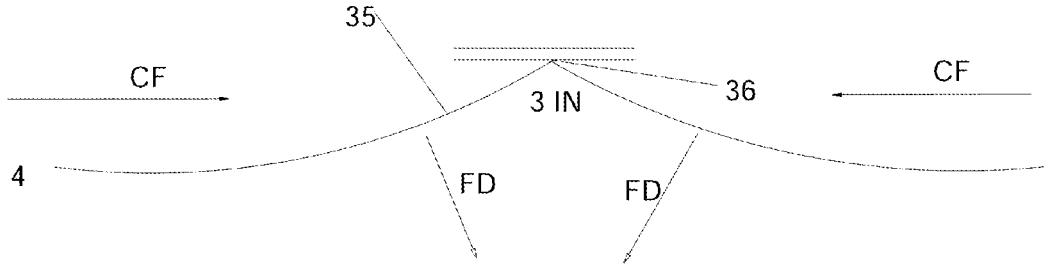
FIG. 1H shows a diagram of an inward fold on a piece of optical film.
Figure 1I:
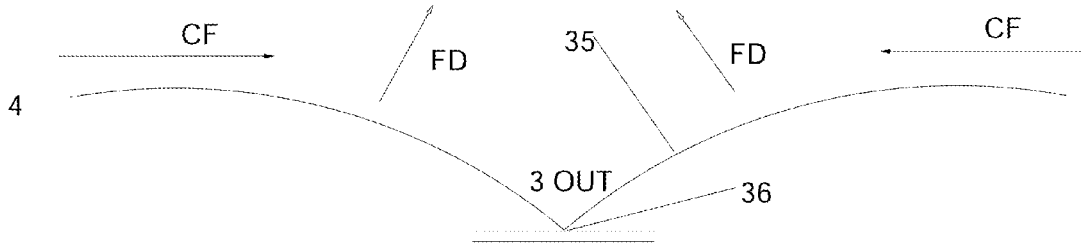
FIG. 1I shows a diagram of an outward fold on a piece of optical film.

Referring to FIG. 1H, the diagram shows a film piece 4 with the front light light-emitting side of the film 35 shown on top. An inward fold is shown along fold line 3 IN, wherein the peak 36 of the fold is on the front surface of the film 35, and the film sections on either side of the crease may be predisposed to fold inward and away from the peak of the crease as shown by the arrows FD (folding direction). The double lines represent a static fixed surface, which may restrict the fold 3 IN from upward movement. When lateral compression forces are applied to the sides of the optical film in the direction as shown by arrows CF, the film sections on either side of the crease may be predisposed to fold away from the peak of the crease as shown by the arrows FD. Referring to FIG. 11, the diagram may show a reverse fold orientation. A film piece 4 with the front light light-emitting side of the film 35 is shown on top. An outward fold is shown along fold line 3 OUT, wherein the peak 36 of the fold is on the back surface of the film 4, and the film sections on either side of the crease may be predisposed to fold outward and away from the peak of the crease as shown by the arrows FD (folding direction). The double lines represent a static fixed surface which may restricted the fold 3 OUT from downward movement. When lateral compression force are applied to the sides of the optical film in the direction as shown by arrows CF, the film sections on either side of the crease may be predisposed to fold away from the peak of the crease as shown by the arrows FD. Accordingly, a piece of film may be selective configured with one or more substantially parallel inward folds or one or more substantially parallel outward folds that may allow the film piece that is laterally compressed toward the fold axes and subsequently restricted within a lens containment feature, to form a variety of profile shapes.

A "lens containment feature" may comprise any frame, channels, assembly or mechanical features that may suitably restrict the movement of portions of the edges of example embodiments of compression lenses. Said restriction of movement may be more fully described later. For example, a lens containment feature may comprise a light fixture doorframe. Typical troffer light fixtures may have four-sided doorframes comprising four generally U-channel frame members connected together as shown in by numeral 2 in FIG. 1B, and wherein an acrylic lens may typically mount. Suitable channels may also be configured into the inner sides of a light fixture enclosure. For example, recessed grooves or channels can be configured into the side walls of a light fixture enclosure by stamping or bending them into the sheet metal. Brackets, extrusions, or clips etc. that may attach to the inner sides of an enclosure may also be utilized. In light fixture applications, it may be preferable to have a lens containment feature be continuous along the entire periphery of an example embodiment of compression lens, wherein the all the lens's edges may be protected and supported. This may be advantageous from a durability and stability perspective with respect to installation, maintenance and handling of a light fixture.

Lens containment features need not be continuous from a pure functionality perspective in example embodiments of compression lenses however. For example, each edge truss 16 (FIG. 1F-3) may be attached at each end to corresponding opposing sides of a light fixture enclosure. With a suitably rigid edge truss configuration, the edge trusses may remain acceptably planar in all directions when the film piece is compressed. In another example, given a suitably rigid optical film piece, only portions of the top edge T and bottom edge B of the film piece 4 in the area of the folds 3IN may need to be restricted in order to retain the compressed lens 4 (FIG. 1F-2) as shown.

FIG. 1F-3 may show a perspective view of an uncompressed piece of optical film configured for an example embodiment of compression lens assembly, wherein the front light-emitting side of the film may be facing forward. The piece of optical film 4 may be configured (as previously described) with 3 inward folds 3IN. The optical film 4 may comprise a left edge L, a right edge R, a top edge T and a bottom edge B. The optical film piece 4 may be shown in an uncompressed state, wherein the uncompressed edge length of the top edge may be represented by the notation UEL. Edge trusses 16 may be configured on each of the left edge L and the right edge R as described in related applications, wherein each edge truss may comprise at least one truss side configured from a corresponding fold in the piece of optical film. The at least one truss side of each of each edge truss may be configured at an angle relative to the top light emitting side of the optical film piece, and may be configured to resist deflection of each edge truss. The edge trusses shown may be configured at an angle of about 90 degrees relative to the front light-emitting side of the film piece 4.

FIG. 1F-2 may include a troffer doorframe 2 comprising four generally U-channel frame members connected together, and may comprise a left channel L, right channel R, top channel T, bottom channel B, a Y-axis Y, an X-axis X, and a Z-axis Z. The top frame member T may be shown as transparent for illustrative purposes, so that the resultant lens profile may be visible. The distance between the left channel L and the right channel R may be smaller than the uncompressed edge length UEL of the film piece. The uncompressed optical film piece 4 from FIG. 1F-3 may be laterally compressed in the direction of the arrows CF as shown in FIG. 1F-2, and inserted into the doorframe 2, wherein the portions of the film's edges L, R, T and B may be restricted by the corresponding sides of the doorframe 2.

The top channel T and the bottom channel B may engagingly secure and restrict movement of the corresponding edges T and B of the film piece 4 in at least the Z-axis direction. The left channel L and the right channel R may to slidingly accept in a Y-axis direction at least a portion of the edges or edge trusses 16 of the film piece 4 at the corresponding left and right edges, and engagingly restrict movement and compress in an X-axis direction at least a portion of the film piece 4. The optical film piece under compression may form one or more hill or valley profiles between adjacent folds. The resultant compressed lens 4 may appear as shown, wherein the compression of the optical film 4 may cause the folds 3 IN to form hills between adjacent folds that may become pressed against the upper portions of the top channel T and bottom channel B of the doorframe 2, and alternately may cause valleys between the adjacent folds 3IN which may become pressed against corresponding lower portions of said channels. The edge trusses 16 (FIG. 1F-3) may become pressed against the left channel and right channel of the doorframe 2. FIG. 1F may show a side cross-sectional view of the same. The installed and compressed lens 4 in the doorframe 2 may form peaks along folds 3 IN and 3B, and the doorframe 2 may restrict the movement of the lens 4 in the X-axis and Z-axis directions as indicated by the arrows.

The amount of compression tension imparted into an example embodiment of compression lens may be varied to change the shape of the example embodiment profile. By increasing the distance between fold axes for given static lens containment feature dimensions, the compression tension within the lens may increase. When the compression tension increases, the result may be hills with steeper sloping sides, and valleys with a more planar profile. Accordingly, by decreasing the distance between fold axes for given static lens containment feature dimensions, the compression tension within the lens may decrease. When the compression tension decreases, the result may be hills with shallower sloping sides, and valleys with a more rounded profile.

The general principals and functionality of an example embodiment of compression lens assembly as described may subsequently be utilized for subsequent example embodiments herein.

FIG. 1B may show an example embodiment of compression lens in an uncompressed state. An example embodiment may comprise a single piece of optical film 4. The optical film may comprise any type of optical film that may be suitable for an intended application, and may include any type of optical film as described in related applications, that may include diffusion films, diffusion films with light condensing properties, prismatic films, holographic films etc. Diffusion film or diffusion film with light condensing properties may be types of optical film with the widest commercial application. The optical film piece 4 may be configured with three inward folds 3IN, and edge trusses 16 may be configured by inward folds 3B along the opposing left and right edges of the optical film 4, in a similar fashion to other example embodiments. A light fixture doorframe 2 as shown may be a simplified drawing of a troffer light fixture doorframe, in which an acrylic lens may typically mount.

Referring to FIG. 1D, when lens 4 (the same example embodiment shown in FIG. 1B) may be laterally compressed in the direction of the arrows and inserted into the doorframe 2, wherein portions of the lens 4 may be restricted by the doorframe 2. The resultant compressed lens 4 may look similar to that shown in FIG. 1A wherein the compressed optical film piece 4, being restricted by the doorframe 2 as previously described, may cause the folds 3 IN to form alternating valleys, and hills with peaks. FIG. 1C show an underneath view of the installed lens 4 in the doorframe 2 with folds 3 IN forming hills with peaks at the folds, and valleys disposed between adjacent peaks.

Figure 1J:
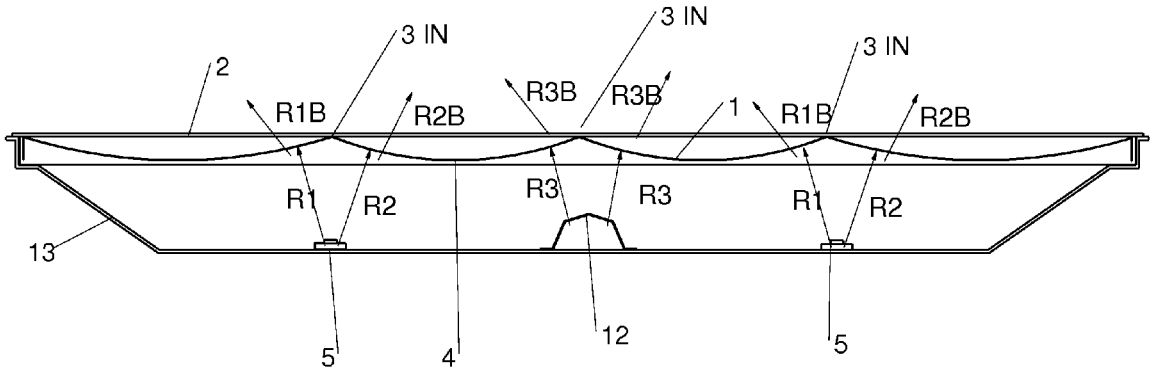
FIG. 1J shows a side cutaway view of an LED luminaire with the example embodiment of compression lens mounted in a luminaire doorframe similar to that shown in FIG. 1A.

When an example embodiment of compression lens installed in a light fixture doorframe as described may be mounted in a luminaire as shown in FIG. 1J, it may exhibit advantageous optical properties and visual aesthetics. LED arrays 5 may be mounted onto the back-reflecting surface of light fixture enclosure 13. As may be typical in troffer luminaires, the LED driver may be mounted inside an enclosure or "wire tray" 12. LED arrays 5 may emit example light rays R1 and R2, and wire tray 12 may emit reflected light rays R3. The propagation of light from a light source through a bi-planar lens may have been described in detail in a related application, and will not be repeated here. In a common luminaire lens application, the lens material may comprise diffusion film or preferably diffusion film with light condensing properties. In an over simplified summary, example light rays R1 and R2 refracting through an example embodiment of compression lens 4 with inward folds 3IN, may be diverted further away from the normal axis of LED arrays 5 as shown by refracted light rays R1B and R2B, which may function to reduce pixelization of the individual LEDs, reduce the apparent lamp image and increase lamp hiding. As a result, it may be possible to utilize a diffusion film with lower diffusion levels and higher transmission levels than may otherwise have been utilized with a flat lens in order to achieve the same level of overall lamp hiding and pixelization reduction. This may allow higher luminaire efficiency. Reflected example light rays R3 from the wire tray 12 refracting through compression lens 4 may be diverted further away from the normal axis of the wire tray 12 as shown by example refracted light rays R3B, which may function to increase visual masking of the image and shadows of the wire tray on the compression lens 4.

FIG. 1E shows a flat pattern cutting template of the example embodiment of optical film compression lens as described in FIG. 1A. The inward folds created on the assembled lens may be created along score lines 3IN, and edge trusses sections 16 may be created long score lines 3B. Score lines 10 may function to create refraction features (as described in a related application) on the lens surface, and may be configured on the film surface from either side, however, it may be visually more pleasing if the score lines 10 are applied to the backside of the lens. The score lines may be created by any suitable means as previously described. The score lines 10 may be configured in any suitable pattern that may function to increase the visual appeal of the lens, or function to obscure the lamp image and reduce pixelization. As shown in FIG. 1E, score lines 10 may be centered around the folds 3IN which may after installation, be disposed directly above the LED arrays 5 as shown in FIG. 1J. The distance between score lines may be increased with the distance away from the associated fold, which may exhibit a relative inverse relationship to the LED array brightness on the lens with relation to the lateral distance from the folds. This may function to lower pixelization and lamp imaging, and may also increase the apparent depth of the lens hills, which may increase the visual appeal of the lens.

In an example embodiment, a compression lens is shown in FIGS. 2A, 2B and 2C. Referring to FIG. 2C, an optical film piece 4 may be configured with fold 3 IN and 3 OUT, and inward folds 3B may form edge trusses 16 as shown. The optical film piece 4 may be laterally compressed in the direction of the arrows, and subsequently inserted into the light fixture doorframe 2. FIG. 2B shows a backside perspective view of the same example embodiment of the compressed lens 4 in the doorframe 2, with folds 3IN and 3OUT. FIG. 2A shows a topside view of the same. When the two pairs of outward folds are configured adjacent to each other as shown by 3 OUT, and an example embodiment is compressed and installed as shown into doorframe 2, curved hill profiles may be created between adjacent folds 3 OUT. When an inward fold 3 IN is configured between the two pairs of outward folds 3 OUT as shown, and an example embodiment is compressed and installed as shown, hills with peaks may be created between the two curved profile sections Hills may also be formed with peaks being disposed along opposing edges of the optical film piece 4 (folds 3B in FIG. 2C).

The two curved profile sections of the example embodiment as described may be configured such that they may be disposed directly over and parallel to a linear LED array (or any linear light source) when the lens may be installed in a light fixture. When a diffusion material or diffusion material with light condensing properties is utilized as the optical film, the round profile sections may function to increase lamp hiding and lower pixilation as previously described. The center peak between the two rounded hill profiles may be configured to be disposed directly over a center mounted wire tray in troffer light fixture, and the shadows created by the wire tray may be partially obscured or blended to a degree as previously described.

Figure 2D:
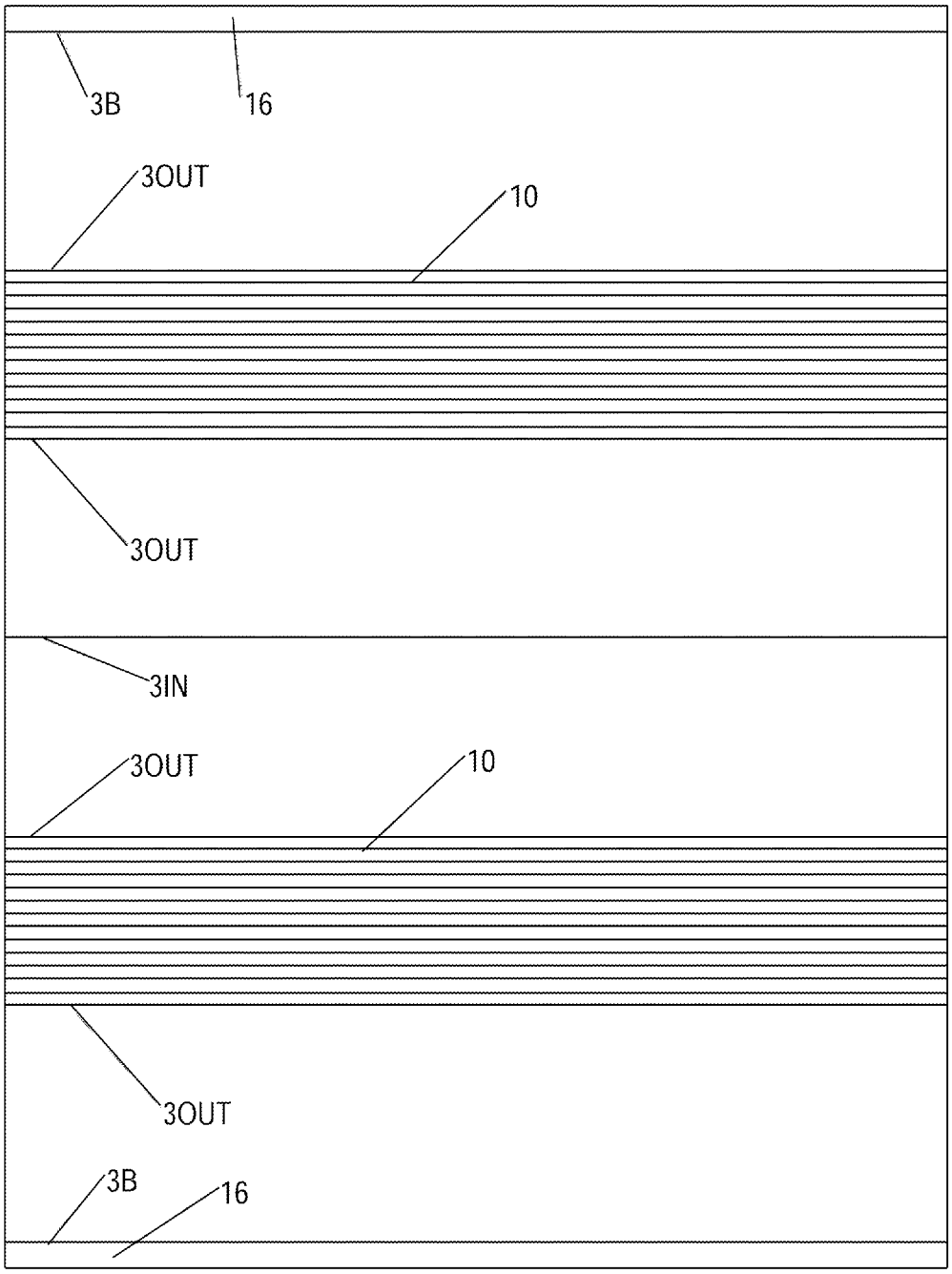
FIG. 2D depicts a flat pattern cutting and scoring template of the example embodiment of lens depicted in FIG. 2A, and includes linear refraction features.

FIG. 2D shows a flat pattern cutting template for the example embodiment shown in FIG. 2A. Folds may be created along score lines 3OUT and 3IN, and edge trusses sections 16 may be created long score lines 3B. Score lines 10 may be configured as previously described, and disposed between each pair of folds 3OUT as shown, and may function to create refraction features on the curved profile sections lens surface. The score lines 10 may be configured in any suitable pattern that may function to increase the visual appeal of the lens, or function to obscure the lamp image and reduce pixelization. The score lines 10 may be disposed between the two pairs of folds 3OUT, wherein these areas may be disposed directly above a linear light source in a luminaire when the example embodiment of lens is compressed and installed therein. These refraction features may function to lower pixelization and lamp imaging, and may also increase the visual differentiation and depth of the curved profile lens sections, which may increase the overall visual appeal of the lens.

An example embodiment of compression lens, compression reflector, and LED luminaire incorporated the same may now be described, and shown in FIGS. 3A, 3B, and 3C.

Figure 6:
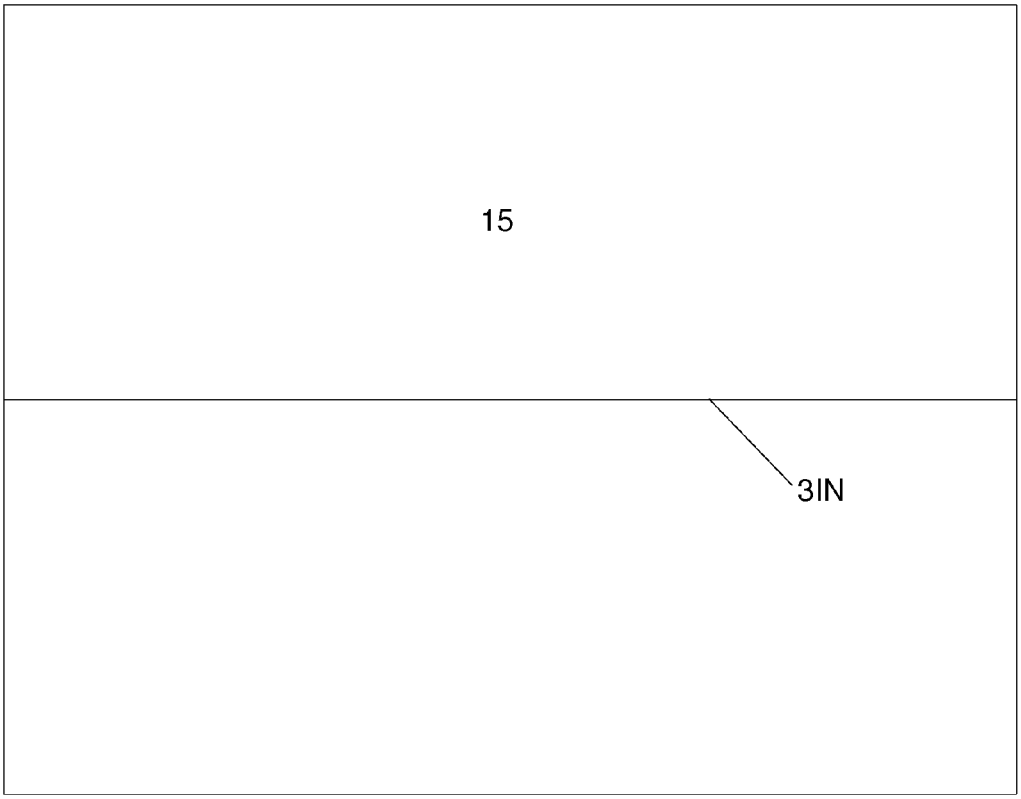
FIG. 6 depicts an example embodiment of flat pattern cutting and scoring template of the reflector panel from the example embodiment of luminaire shown in FIG. 3A.

FIG. 3B may show a cutaway perspective view of an example embodiment. The luminaire enclosure 6 may have flanges 17 on all four sides of the perimeter of the aperture of the luminaire enclosure 6. A reflector may panel 7 may be configured from a flat sheet of material, as shown in FIG. 6, wherein flat sheet 6 may comprise an inward fold 3IN in the middle as shown. The material may comprise reflection material such as painted sheet metal or high efficiency plastic diffusion material for example, and may therefore function as a reflection surface. Alternatively, the panels may comprise any suitable semi rigid material that may subsequently act as a mounting substrate for a reflection film. This method may have cost savings advantages. Low cost thin reflection films with approximately 97% efficiency may be utilized along with low cost semi rigid panels, which may yield a lower cost than commercially available thicker high efficiency semi rigid panels. In either case, opposing edges of the flat reflection panel shown in FIG. 6, may be laterally compressed towards each other and inserted into the luminaire enclosure 6 in FIG. 3B, wherein the flat edges of the reflector 7 and the peak of the fold 3IN may be disposed underneath the luminaire flanges 17, and may form two curved reflection surfaces. This method of creating curved reflector panels may have the advantage of manufacturing cost savings and decreased tooling cost compared to traditional sheet metal preformed reflectors.

In the same example embodiment in FIG. 3B, heat sinks 5 may be mounted near the aperture of the luminaire with the fins aligned away from the enclosure 6. The heat sinks 5 may protrude through corresponding holes in the luminaire enclosure 6, and secured with screws or pins etc. protruding through the sections of the heat sinks that may be disposed outside the luminaire enclosure. The heat sinks 5 may also be attached to the luminaire in any other suitable method, such as screws or adhesives.

As shown in FIG. 3B, LED arrays 8 may be attached to the heat sinks 5 with thermal adhesive or screws etc. The LED driver and wiring may be disposed underneath the center section of the reflector 7.

Commercially available heat sinks may have slots along their sides that may be used to mount diffuser lenses, and are indicated by numerals 21 on FIGS. 3C and 3B. Any suitable profile of metal (preferably aluminum) extrusion may be created that may comprise suitable side slots as well as suitable thermal and dimensional properties The heat sink slots 21 may be utilized to mount example embodiments of compression lens.

FIG. 4A shows a flat pattern cutting pattern of an example embodiment of optical film compression lens 1A. The installed compressed lenses are indicated by 1A in FIG. 3A. Outward folds may be created along score lines 3 OUT as previously described. The arrows may show the direction of lateral compression forces that may be applied during installation. Edge truss 16 may be created along fold 3 OUT as indicated. FIG. 4B shows a flat pattern cutting pattern of an example embodiment of optical film compression lens 1B. The installed compressed lens may be indicated by 1B in FIG. 3A. Two outer outward folds may be created along score lines 3 OUT, and a center inwards fold that may be created along fold 3 IN. The arrows may show the direction of lateral compression forces that may be applied during installation.

FIG. 3C may show a perspective exploded view of the example embodiment shown in FIG. 3B, with both lens sections 1A and lens section 1B in their uncompressed state. Edges 90 of lens sections 1A may be inserted into slots 21, and the edge trusses 16 may be inserted under the enclosure flanges 17, which may cause compression forces to be exerted on the lens sections 1A, causing them to conform to the shapes shown in FIGS. 3A and 3B. Both peaks of the center fold 3 IN on lens section 1B may be placed on top of the reflector 7, and underneath the center section of the opposing luminaire flanges 17, and the opposing edges 90 on lens section 1B may be inserted into heat sink slots 21, which may exert compression forces on the lens section 1B causing the lens section 1B to conform to the shape shown in FIGS. 3A and 3B.

Figure 5:
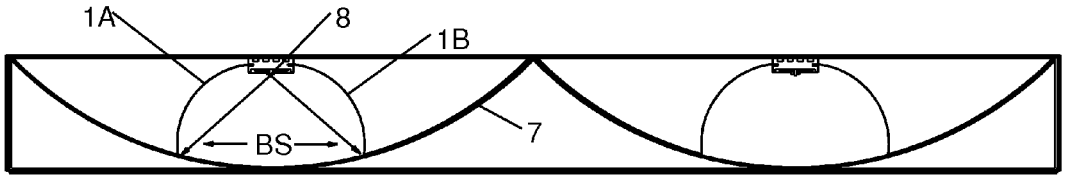
FIG. 5 depicts a cutaway side view of the example embodiment of LED luminaire shown in FIG. 3A showing the beam spread of the LED light source.

There may be advantages associated with an example embodiment of LED compression lens and LED luminaire as described. Referring to FIG. 5, LED array 8 may have a beam spread indicated by BS, which may cause direct light from the LEDs to be incident on the reflector surface 7 between the arrows as shown. Accordingly, the majority of light from the LED array incident on the lens surfaces 1A and 1B may be reflected light from the curved reflector that may function to create a homogenously illuminated lens. Because the light striking the lens may be soft and diffuse reflected light, a very light diffusion film may be utilized for the lens material. If high efficiency reflection material is utilized for the reflector 7, the result may be a very evenly illuminated and soft lens with very high efficiency and no pixelization or lamp image.

A beneficial advantage of the example embodiment of compression lens described in FIGS. 3A, 3B and 3C may be that the lens sections may cover the portions of the reflector surfaces that do not receive direct light from the LED arrays. Thin high efficiency reflection films such as RW188 manufactured by Kimoto-Tech may have fragile surfaces that are very easily marked or damaged. Accordingly, although lower cost, they may not be able to be utilized as exposed reflection surfaces in a luminaire. When an example embodiment of compression lens as describe may be utilized, it may cover the exposed surfaces of the fragile reflection film, thus enabling its use. The combination of diffusion film over top of a reflection film or surface may exhibit a unique pearlescent finish that may be distinctively different from typical commercially available reflection surfaces. High quality diffusion film may also present a durable and cleanable reflector surface.

A method for creating an example embodiment compression lens assembly will herein be described as follows:

a) Configure at least one piece of optical film to the appropriate dimensions and shape for a given application and lens containment feature. The optical film piece may comprise a left edge defining a Y-axis, a right edge that is substantially parallel to the left edge, a top edge defining a X-axis and having an uncompressed edge length UEL, a bottom edge that is substantially parallel to the top edge and having an uncompressed edge length about UEL. The at least one piece of optical film may further comprise a Z-axis that is perpendicular to the X-axis and the Y-axis, a top light-emitting side and a bottom light-receiving side.

b) Optionally, one or more score lines may be configured on the optical film piece wherein folds may be created along the one or more score lines.

c) Create one or more inward folds and or one or more outward folds extending from the top edge to the bottom edge of the piece of optical film, wherein the one or more folds may be substantially parallel to one or more of the left edge and the right edge. The folds may be created along score lines if so configured from step b).

d) Optionally, create an edge truss on each of the left edge and the right edge of the optical film piece, wherein each edge truss may comprise at least one truss side configured from a corresponding fold in the at least one piece of optical film. The at least one truss side of each of each edge truss may be configured at an angle relative to the top light emitting side of the at least one piece of optical film and may be configured to resist deflection of each edge truss.

e) Configure a lens containment feature that may comprise any frame, channels, assembly or mechanical features that may suitably restrict the movement of portions of the edges of the previously configured at least one optical film piece. The lens containment feature may comprise a top channel and a bottom channel having channel lengths CL that are smaller than the uncompressed edge length UEL of the top and bottom edges of the at least one piece of optical film. The top channel and bottom channel may be configured to engagingly secure and restrict movement of the corresponding top and bottom edges of the at least one piece of optical film in at least the Z-axis direction. The lens containment feature that may further comprise a left channel and a right channel configured to slidingly accept in a Y-axis direction at least a portion of the at least one piece of optical film at the corresponding left and right edges, and to engagingly restrict movement and to compress in an X-axis direction at least a portion of the at least one piece of optical film.

f) Compress the left and right edges of the previously configured optical film piece towards each other and insert the optical film piece into the previously configured lens containment feature, wherein each edge of the optical film piece may align with the proper corresponding channel of the lens containment feature, wherein the at least one piece of optical film under compression may form one or more hill or valley profiles between adjacent folds.

Example embodiments of compression lens assemblies and compression reflectors may have herein been described. It should be clearly understood that the particular format or style of the configurations of example embodiments should not limit the scope of possible style and format configurations that are possible using compression lenses and reflector methods described. Through the selective configuration of the optical film size, fold configurations, the dimensions of lens containment feature, along with other parameters previously described, many possible style and formats of compression lenses and reflectors may be created.

Although example embodiments have been described in conjunction with light fixtures, the scope of applications of alternate light emitting devices and lens systems should not be restricted. Any type of light emitting device that may utilize a lens may be suitable for use with example embodiments herein described.

Various methods, concepts, designs, and parts may be combined to produce desired operating specifications of LED light fixtures, lens-partitioning elements, as well as methods for mounting LED arrays in a light emitting device, and will be described with reference to the accompanying figures. Certain example embodiments of lens-partitioning elements may be described in combination with certain example embodiments of LED light fixture designs. However, this should in no way limit the scope of each individual example embodiments of LED light fixture or lens-partitioning elements.

Linear LED arrays comprising linear LED strips with one or more rows of LEDs may currently present one of the most economical choices for light fixtures utilizing LED light sources. They may cost significantly less than LED panel style arrays for a given lumen output, yielding a significantly lower lumen output per dollar of cost. However, linear LED arrays may create significant bright areas on a lens surface directly above them, and significant shadows on other areas of the lens surface. In a troffer light fixture for example, typically two LED arrays may be mounted parallel to each other in the fixture. Due to the linear configuration of the light source, the light dispersion pattern from the light fixture may not be symmetrical in the X and Y viewing planes. This may also create a visually unbalanced, unappealing and inexpensive look. Traditional fluorescent troffers also have linear light sources, but perhaps due to the omni-directional light output from the fluorescent tubes, light may become more uniformly distributed inside the light fixture and on the lens surface. Example embodiments of the disclosed technology may subsequently describe embodiments of LED fixtures, lenses and lens-partitioning elements that may overcome the disadvantages as described, but without significantly increasing manufacturing costs.

Figure 7A:
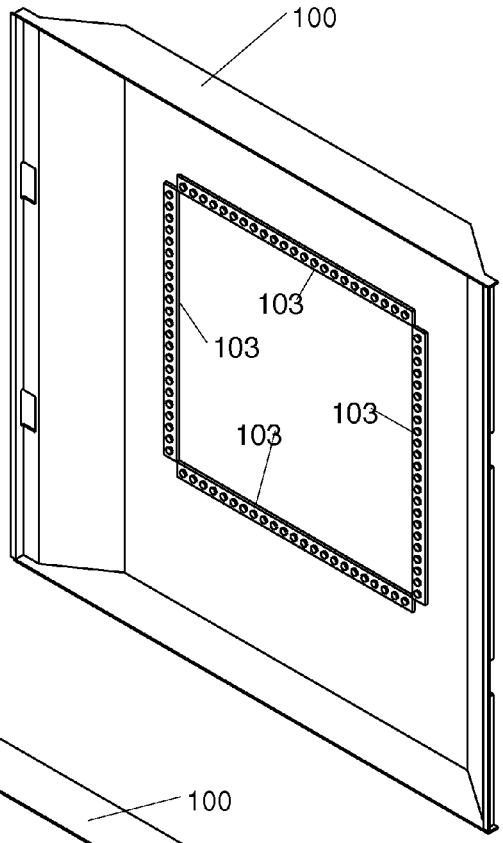
FIG. 7A depicts a simplified perspective view of an example embodiment of light fixture enclosure with the lens removed, and linear LED arrays mounted in a four-sided pattern.

An example embodiment of LED light fixture with linear LED arrays may now be described. FIG. 7A shows a perspective view of an example embodiment of troffer light fixture with linear LED arrays. The doorframe and lens have been removed for depiction purposes. Four LED arrays 103 may be mounted in a four-sided pattern on the inner surface of a light fixture enclosure 100. Each LED array may preferably comprise one LED strip, however more than one LED strip may be used in an LED array if there may be some manufacturing or optical advantage. The LED arrays 103 may be mounted in an approximate end-to-end configuration, wherein the ends of each LED array may be mounted in proximity to each other. The amount of separation and mounting angles configured between adjacent ends of LED arrays may determine the configuration of the shadows created due to the absence of a light source, as well as the relative shape the LED arrays may form, and accordingly may be configured according to the desired visual aesthetic. When LED arrays are mounted wherein the relative angle between adjacent LED arrays may be approximately 90 degrees, the area inside the LED arrays may form a substantially square or rectangular shape, depending on the length of LED arrays. FIG. 7C shows the area inside the LED arrays indicated by the shaded area marked M. The exact dimensions of the mounting pattern and the proximity of each LED array to each other may be varied to suit the intended application and visual aesthetic requirements.

An LED-mounting configuration as described may create a four-sided illumination pattern on a lens surface that may be distinctly different, more balanced, and visually more appealing than standard parallel LED array mounting methods. The diffusion properties of a diffuser lens may function to soften the edges and corners of the illumination pattern on the lens, and create a soft ring type appearance. This may also create a more symmetrical illumination pattern in the X and Y viewing planes, and give a more pleasing uniform lens illumination. Example embodiments of LED fixtures with LED arrays mounted in a four-sided pattern may have little to no increased manufacturing costs, but may provide the benefits as described.

Example embodiments of LED light fixtures with LED arrays mounted in four-sided patterns need not have the edges of the four-sided pattern mounted parallel to the edges of the light fixture. FIG. 11B shows an example embodiment of a light fixture with four LED arrays 103 mounted in a diamond pattern. Accordingly, LED arrays configured in four sided patterns may be mounted in a light fixture in any orientation that may be visually acceptable.

Example embodiments of LED light fixture may also include linear LED arrays mounted in other symmetrical patterns such as octagonal and hexagonal for example. Octagonal or hexagonal mounting patterns may also give a symmetrical light distribution pattern from the light fixture, as well as a unique visual appeal. FIG. 12B may shows an example embodiment of LED light fixture with LED arrays 103 mounted in a hexagonal pattern wherein the relative angle between adjacent LED arrays may be approximately 120 degrees. Example embodiments of lens-partitioning elements that may be subsequently described may be tailored in their configuration to conform to different LED array mounting patterns.

Example embodiments of light fixture utilizing linear LED arrays as described may create the benefits as described. However, as may be inherent in any linear LED light source in a light fixture, non-uniform lens illumination with shadows and bright zones may be unavoidable. Example embodiments of LED light fixtures with linear LED arrays mounted in an approximate square or rectangular pattern may exhibit a darker shadowed area on the lens in the vicinity of the area inside the square pattern, as indicated by area 110 in FIG. 8B, as well as bright areas directly over the LED arrays 103. Although the non-uniformity of illumination on a lens may be unavoidable, an example embodiment of lens-partitioning element "LPE" may function to add a visually appealing defined structure to the bright and shadowed areas.

Figure 7B:
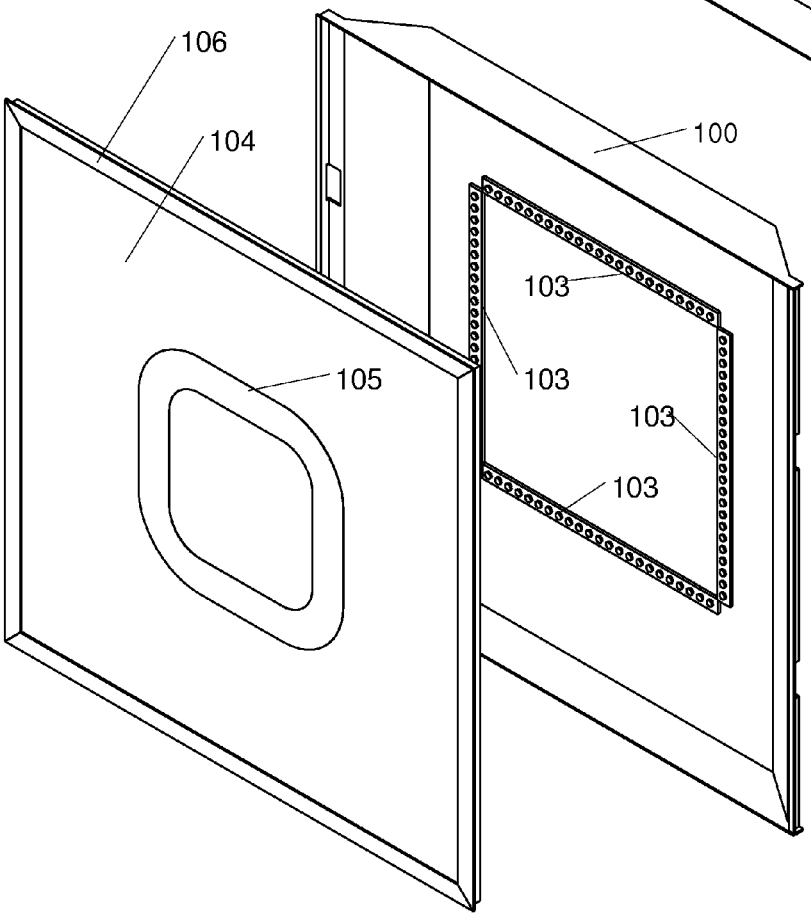
FIG. 7B depicts an exploded perspective view of an example embodiment of light fixture enclosure and linear LED arrays mounted in a four-sided pattern, along with a lens, doorframe and example embodiment of lens-partitioning element.
Figure 7C:
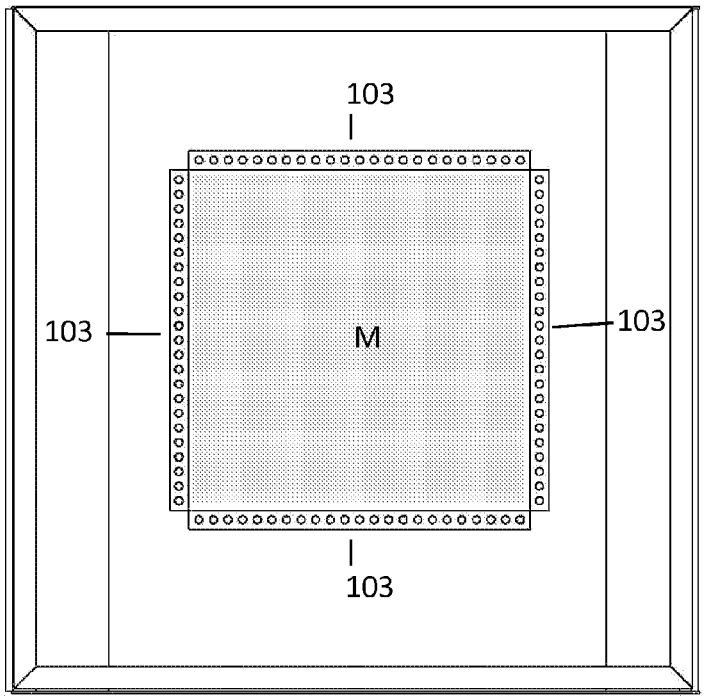
FIG. 7C shows a shaded area disposed inside the boundaries of four LED arrays.

FIG. 7B shows a perspective exploded view of an example embodiment of light fixture with linear LEDs mounted in an approximate square pattern as previously described. The troffer light fixture may include a lens 104 mounted in a doorframe 106, that may be typical of commercial troffer light fixtures. An example embodiment of LPE 105 may be shown mounted on the backside of the lens 104.

In an example embodiment as shown in FIG. 7B, the LPE 105 may be fabricated in an approximate "ring" shape, with a cutout in the central portion of the LPE 105, and may be fabricated from any suitable opaque, transparent or translucent film or material, but may preferably be translucent optical film, such as diffusion film. A translucent optical film may result in higher luminaire efficiency than example embodiments of LPEs fabricated from opaque materials, and may have a more pleasing visual appeal. The LPE 105 may be mounted on either the front or back surface of a lens, but mounting on the back surface may be visually more acceptable. The LPE 105 may be attached to the lens surface utilizing any method that may be visually acceptable, such as lamination or adhesives. The surface of the LPE 105 that attaches to the lens 104 may be configured with refraction feature patterns or textures etc. that may give a visually appealing look on the lens 104 surface, and may help mask any imperfections such as air pockets in the adhesive or lamination.

Figure 8A:
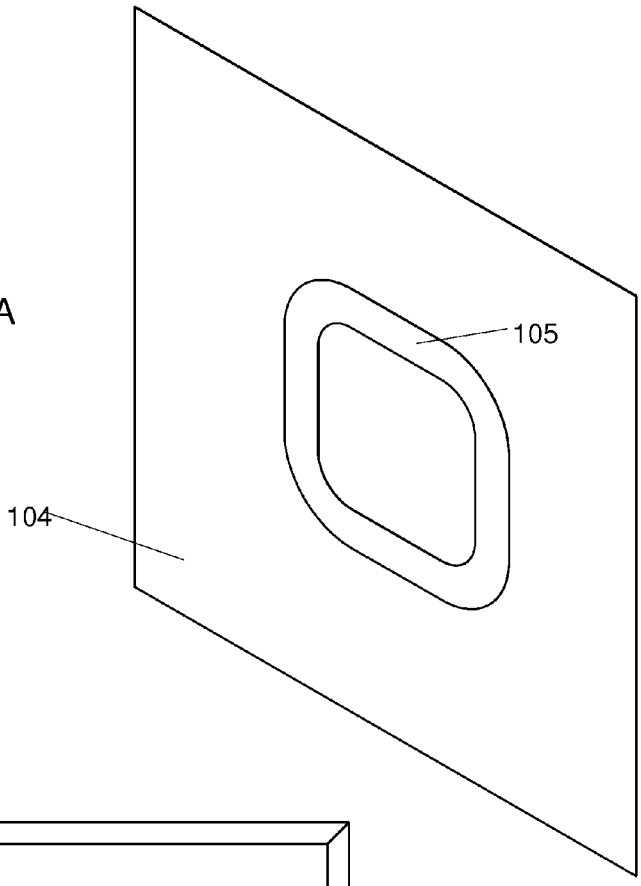
FIG. 8A depicts a perspective view of a lens with an example embodiment of inner lens-partitioning element mounted on its surface.
Figure 8B:
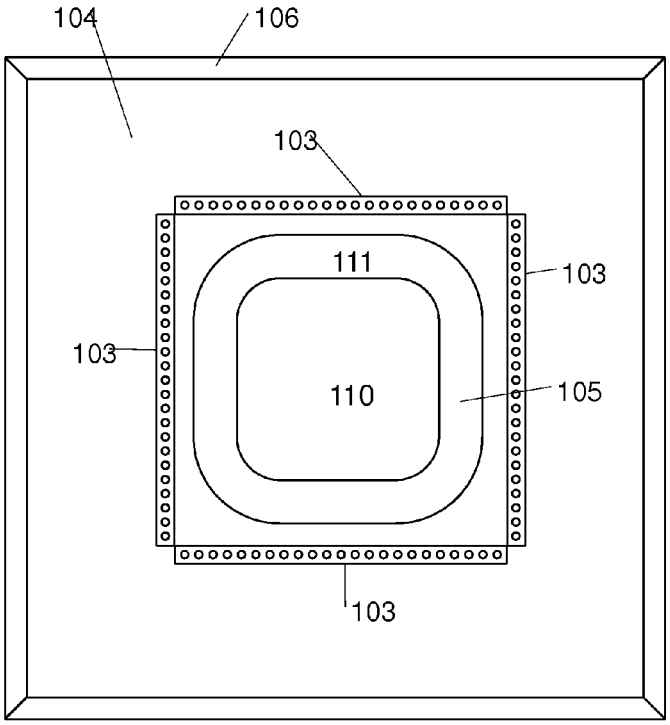
FIG. 8B depicts a front view of an example embodiment of inner lens-partitioning element mounted on a lens attached to an example embodiment of LED fixture with LED arrays mounted in a square pattern. The lens has been shown as transparent to show the placement of the LED arrays.

FIG. 8A shows the backside of a lens 104 with an example embodiment of LPE 105 mounted to the lens surface in a central location. In an example embodiment, the LPE 105 may be symmetrically located in the central part of the lens 104. Referring to FIG. 8B, the LPE 105 may be mounted on lens 104 (the lens 104 may be as shown as transparent for illustrative purposes) in the doorframe 106 on an example embodiment of light fixture with linear LED arrays 103 mounted in a square pattern. The LPE 105 as shown may create a discrete defined geometric pattern 111 on the lens 104 in the area defined by the overlay's surface area 111. As shown, the LPE 105 may be located in an area inside the square defined by the inside edges of the LED arrays 103, and its outer edges placed in proximity to the area where lens shadowing may begin to occur. This may create a sharp defined cutoff of the bright illumination area over the LED arrays 103 and create a defined and relatively uniform shadowed area defined by the surface area 111 of the LPE 105. The lens surface inside the cutout area of the LPE 105 as indicated by area 110, may create yet another discrete and defined shadow area. The overall effect may be a visually appealing transition of visually discrete areas or "rings" of varied illumination from the center of the lens 104 towards the outside of the lens 104. This may function to create a visual illusion wherein the location and layout of the light source may not be readily discernable, and may appear as a panel style LED array. Advantageously, light reflecting from the inner sides of the light fixture enclosure may decrease the degree of shadowing towards the outer edges of the lens 104.

Example embodiments of LPE have been configured with rounded corners, which may mimic the general shape of the areas of brighter illumination directly over the LED arrays when the lens comprises a relatively high diffusion material. This may function to maximize the surface area of the brighter illumination areas. However, other shapes may be utilized as well. Any shape which may function to add visually appealing geometric structure to the areas of brightness and shadows may be utilized. For example, the LPE may be oval, circular, square, rectangular, octagonal, hexagonal etc. In addition, an LPE may be configured as any of the shapes described, but configured with no center cutout. Example embodiments of LPE may also be placed in any position that may function to create any desired visual affect. However, if an example embodiment of LPE is placed directly over the LED arrays, luminaire efficiency may decrease.

Example embodiments of inner LPEs may be fabricated in one continuous piece of material; however, this may create a significant amount of material waste. Example embodiments of inner LPEs may also be configured from two, four or more individual pieces. As described, texture or linear refraction features on one or both surfaces of example embodiments of inner LPEs may function to add visual interest, help mask any imperfections with the adhesive or lamination joint, and help mask the seam between individual pieces of inner LPEs.

Figure 9A:
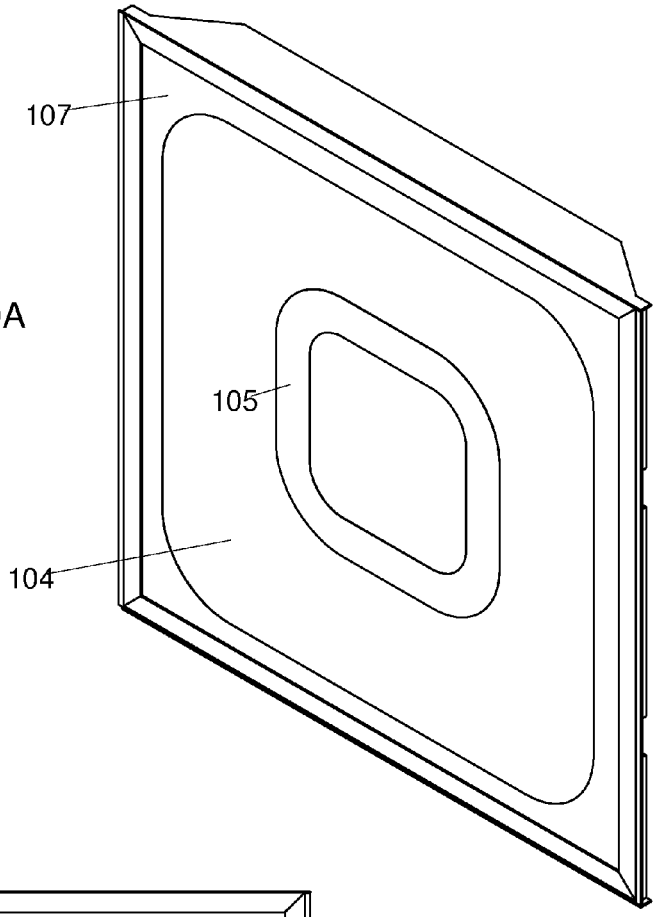
FIG. 9A depicts a perspective view of a lens mounted in a doorframe on a troffer light fixture with an example embodiment of inner and outer lens-partitioning elements mounted on the lens's surface.
Figure 9B:
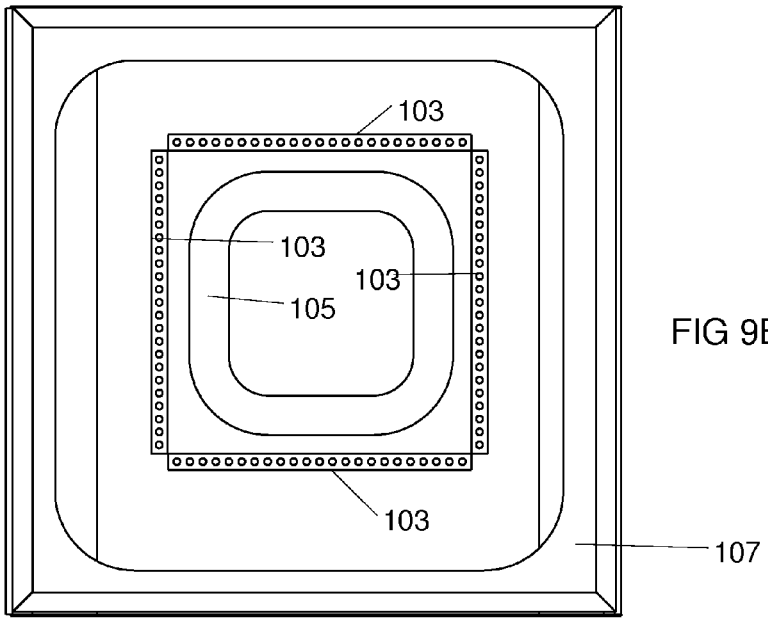
FIG. 9B depicts a front view of an example embodiment of inner and outer lens-partitioning elements mounted on a lens attached to an example embodiment of LED fixture with LED arrays mounted in a square pattern. The lens has been shown as transparent to show the placement of the LED arrays.

In an example embodiment of LPE, an edge LPE may be configured to attach along the outer periphery of a lens. FIG. 9A shows a perspective view of an example embodiment of LPE 105 mounted on lens 104, along with an example embodiment of edge LPE 107 mounted on lens 104. FIG. 9B show a plan view of the same, except the lens may be removed in order to view the mounting locations of the LED arrays 103. The example embodiment of edge LPE 107 may function in a similar manner to that of inner LPE 105 by creating a discrete sharp shadowed area around the outer periphery of the lens 104, which may create a "picture box" visual effect that may give increased visual appeal. In an example embodiment shown in FIG. 9A, the edge LPE 107 has been configured with round corners which may mimic the rounded corners of the inner LPE 105, which may give increased visual appeal. Example embodiments of outer LPEs may also include any shape that may function to add visually appealing structure to the area of shadows along all or a portion of the outer periphery of a lens.

Example embodiments of edge LPEs may be attached to a lens in a similar fashion as those described with example embodiments of inner LPEs. They may be fabricated in one continuous piece of material; however, this may create a large amount of material waste. Example embodiments of edge LPEs may also be configured from two, four or more individual pieces. As described with example embodiments of inner LPE, textures or linear refraction features on one or both surfaces of example embodiments of edge LPEs may function to add visual interest, help mask any imperfections with the adhesive or lamination, and help mask the seam between individual pieces of edge LPEs.

Figure 10:
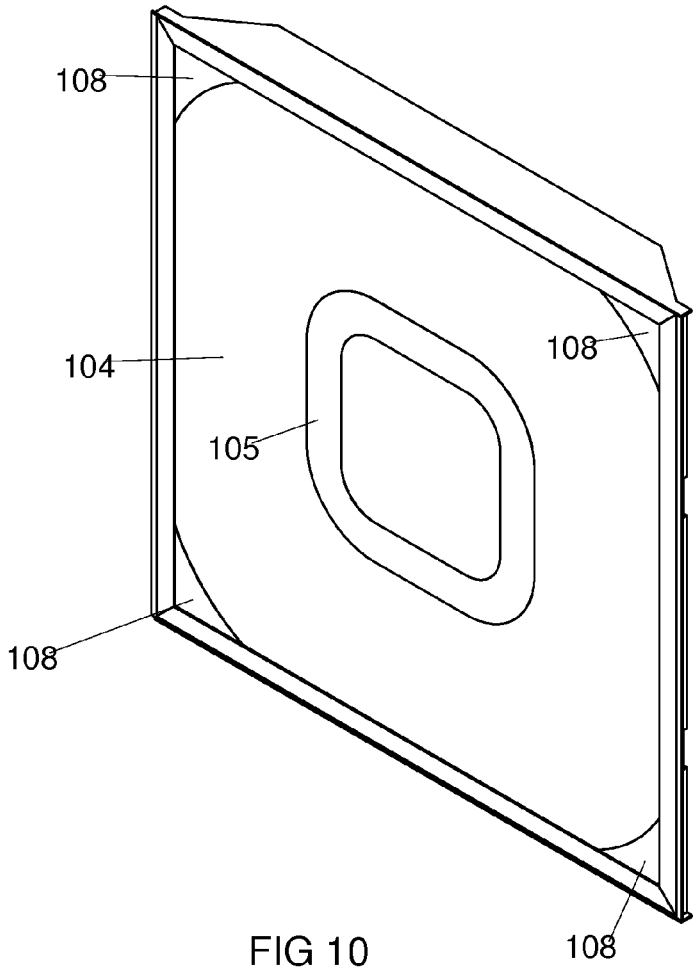
FIG. 10 depicts a perspective view of a lens mounted in a doorframe on a troffer light fixture with an example embodiment of inner and corner lens-partitioning elements mounted on the lens's surface.

In an example embodiment of LPE, a corner LPE may be configured to attach at the corners of a lens. FIG. 10 shows a perspective view of an example embodiment of inner LPE 105 similar to that as described in FIG. 8A, and mounted on lens 104. The fixture shown may be a troffer with LED arrays mounted similarly to that as described in FIG. 1B, along with an example embodiment of corner LPEs 108. In an example embodiment, the corner LPEs 108 may function in a similar manner to that of inner LPE 105 by creating a discrete sharp shadowed area at the corners of the lens 104, which may create a partial "picture box" visual effect that may give increased visual appeal. The doorframe in which the lens may mount in may function to visually fill-in the partial picture box effect created by the corner LPEs 108. In an example embodiment shown in FIG. 10, the corner LPEs 108 have been configured with rounded corners that may mimic the rounded corners of the inner LPE 105, which may give increased visual appeal. Example embodiments of corner LPEs may also include any shape that may function to add visually appealing structure to the area of shadows along the corner of a lens.

Example embodiments of corner LPEs may be attached to a lens in a similar fashion as those described with example embodiments of inner LPE. As described with example embodiments of inner LPE, texture or linear refraction features on one or both surfaces of example embodiments of edge LPEs may function to add visual interest and help mask any imperfections with the adhesive or lamination.

Figure 11A:
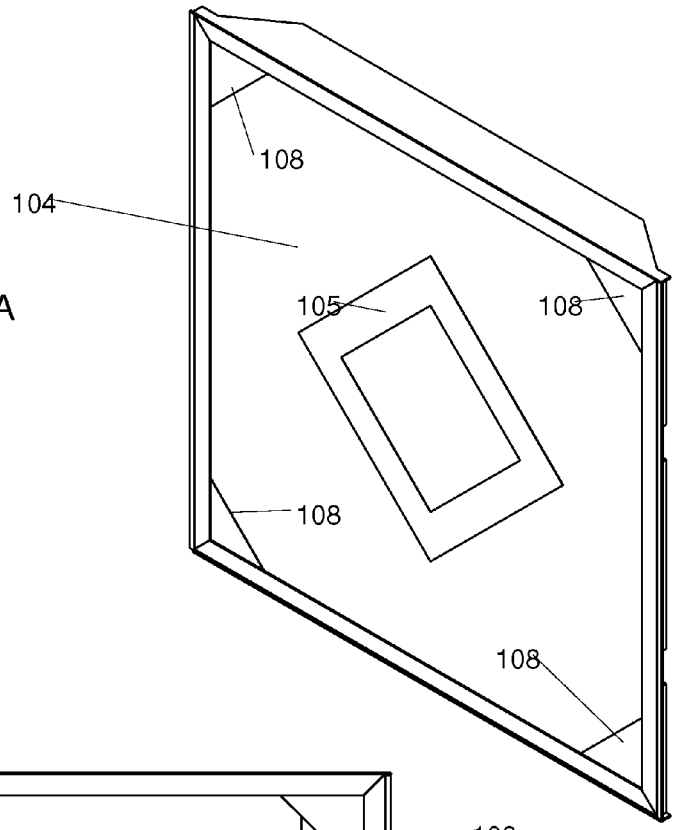
FIG. 11A depicts a perspective view of a lens mounted in a doorframe on a troffer light fixture with an example embodiment of inner and outer lens-partitioning elements mounted on the lens's surface.
Figure 11B:
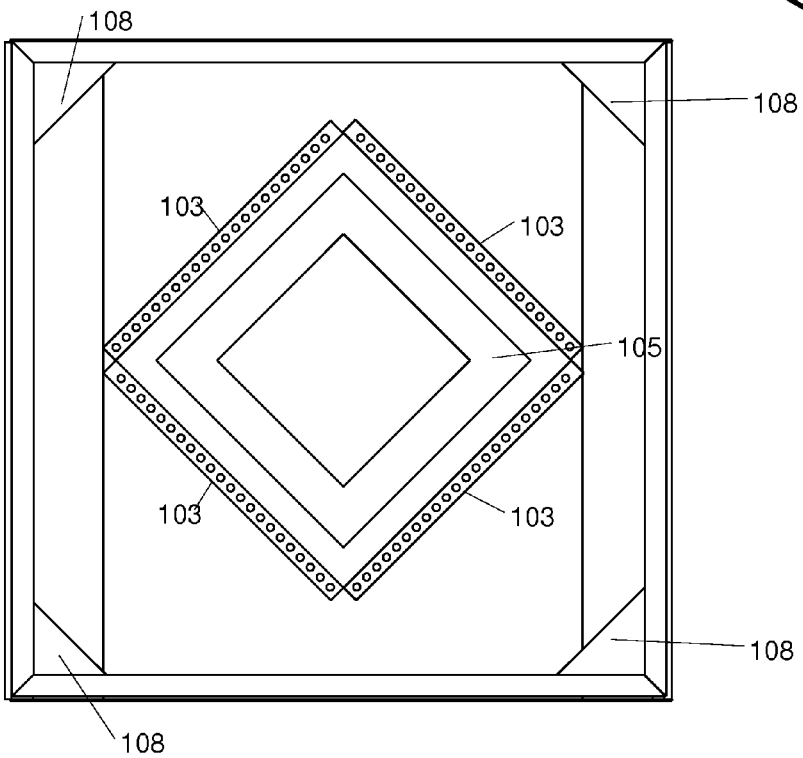
FIG. 11B depicts a front view of an example embodiment of inner and outer lens-partitioning elements mounted on a lens attached to an example embodiment of LED light fixture with LED arrays mounted in a diamond pattern. The lens has been shown as transparent to show the placement of the LED arrays.

An example embodiment of inner and corner LPEs may be shown in FIGS. 11A and 11B wherein the inner LPE 105 and corner LPEs 108 are mounted on a lens 104. The lens 104 has been removed on FIG. 11B in order to show the example embodiment of LED light fixture with LED arrays 103 mounted in a diamond pattern. The inner LPE 105 and the corner LPEs108 may be fabricated and attached to the lens 104 in a similar manner as previously described, and may function similarly to the previously described inner and corner LPEs.

Figure 12A:
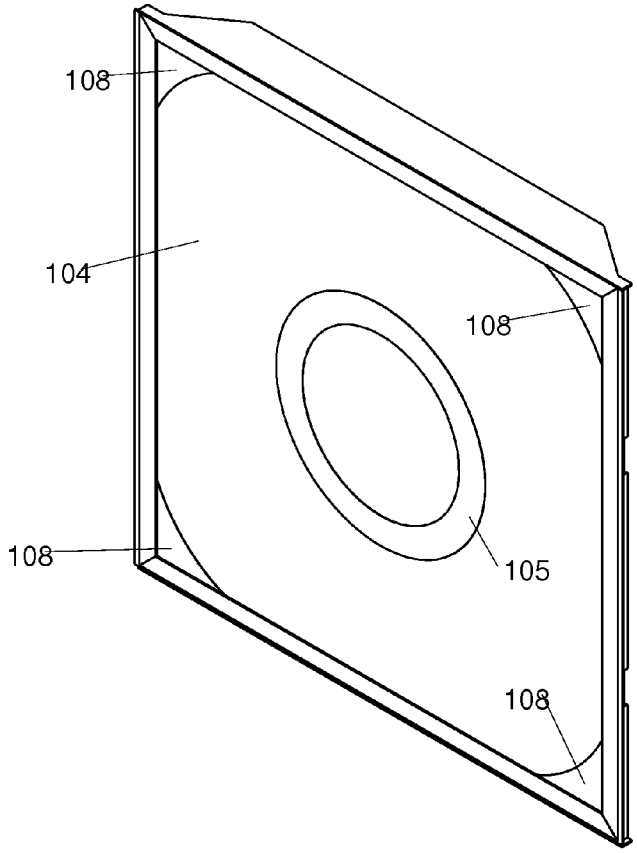
FIG. 12A depicts a perspective view of a lens mounted in a doorframe on a troffer light fixture with an example embodiment of inner and outer lens-partitioning elements mounted on the lens's surface.
Figure 12B:
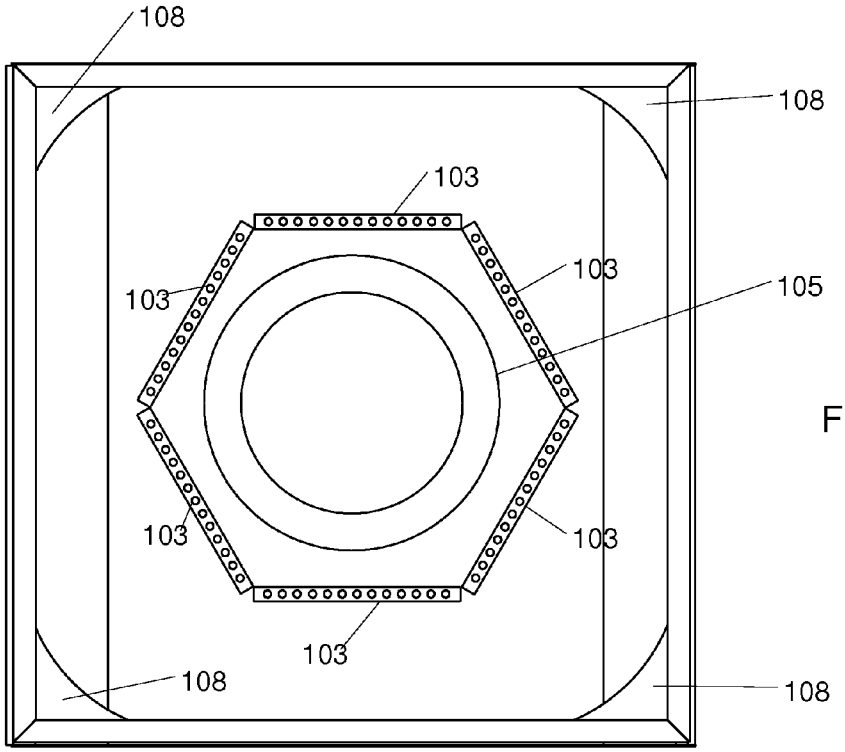
FIG. 12B depicts a front view of an example embodiment of inner and outer lens-partitioning elements mounted on a lens attached to an example embodiment of LED light fixture with LED arrays mounted in a hexagonal pattern. The lens has been shown as transparent to show the placement of the LED arrays.

An example embodiment of inner and corner LPEs is shown in FIGS. 12A and 12B wherein a round ring-shaped inner LPE 105 and curved corner LPEs 8 are mounted on a lens 104. The lens 104 has been removed on FIG. 12B in order to show the example embodiment of LED light fixture with LED arrays 103 mounted in a hexagonal pattern. The inner LPE 105 and the corner LPEs 108 may be fabricated and attached to the lens 104 in a similar manner as previously described, and may function similarly to the previously described inner and corner LPEs.

Certain example embodiments of LPEs may have been described as functioning to add discrete and defined areas to shaded regions of a lens surface. However, example embodiments of LPEs may also create discrete and defined areas in the bright regions on a lens surface and add additional diffusion over the bright areas of a lens. FIG. 14A shows a perspective view of an example embodiment of inner LPE 105 mounted on lens 104 on a troffer with LED arrays mounted similarly to that as described in FIG. 1B. In an example embodiment, lens 104 may comprise any lenses as previously described; however, a lens with lower diffusion properties may be utilized in order to increase luminaire efficiency. The LPE 105 may be configured and mounted on the lens 104 to be co-aligned with the LED arrays 103, and fully cover an area directly above and surrounding the LED arrays 103 as shown in FIG. 14B. In FIG. 14B, the LPE 105 has been made translucent and the lens (104 in FIG. 14A) has been removed for illustrative purposes in order to show the relative positions of LED arrays 103. An example embodiment of LPE 105 may be configured from any suitable material, however optical diffusion film with lighter diffusion properties may function to provide acceptable lamp hiding and diffusion of the LED arrays, as well as minimize light loss. When configured as described, the lighter diffusion properties of LPE 105 combined with lighter diffusion properties of the lens 104 may function to provide acceptable lamp hiding and diffusion of the LED arrays, and to increase overall luminaire efficiency. In an example embodiment, the LPE 105 may also function to create a visually defined discrete area surrounding the LED light sources 103.

An example embodiment of LPEs is shown in FIG. 13A that may create discrete and defined areas in the bright regions on a lens surface and add additional diffusion over the bright areas, similarly to the example embodiment shown in FIG. 14A. In an example embodiment as shown in FIG. 13A, two rectangular shaped inner LPE 105*s* are mounted on a lens 104. The lens 104 has been removed, and the LPEs 105 have been made transparent for illustrative purposes on FIG. 13B in order to show a light fixture with two LED arrays mounted parallel to each other. Referencing FIG. 13A, the two LPEs 105 may be fabricated and attached to the lens 104 in a similar manner, as previously described, and may function similarly to the previously described inner LPEs.

Example embodiments of LPEs may also comprise refraction features that may be printed on a lens surface, as described in a related application entitled "Light Fixtures and Multi-Plane Lenses" wherein refraction features RF comprise a layer or grouping of particles that have been printed on a surface of the lens. In example embodiments, LPEs (inner, outer, corner etc.) may be configured by printing a layer or grouping of particles onto either or both surfaces of a lens. Refraction feature RF may also have a gradient pattern wherein the particles may be denser and or more closely spaced in a certain region of a refraction feature and the particles may become less dense and or spaced further apart in other areas of a refraction feature. Each refraction feature may be printed using printing processes or techniques, utilizing any suitable material, for example, diffusion particles such as glass beads, or white ink with reflective particles such as titanium dioxide. The pattern may be etched onto the lens surface with a laser beam or created in an injection molding or extruding process as described.

Lenses on which example embodiments of LPE's may be attached to, or mounted on, may include any type of lens. For example, lens types may include acrylic prismatic lenses, non-prismatic diffusion lenses, glass lenses, optical film lenses etc.

One of the functional benefits of example embodiment of LPEs may be to create geometric discrete and defined patterns on a lens surface. Accordingly, example embodiments of LPEs may be configured for use on lenses intended for use on fluorescent fixtures, or fixtures with any type of light source.

Although example embodiments have been described in conjunction with light fixtures, the scope of applications of alternate light emitting devices and lens systems should not be restricted. Any type of light fixture or light emitting device, which utilizes a lens, may be suitable for use with example embodiments herein described.

Linear fluorescent light fixtures utilizing clear acrylic prismatic lenses such as fluorescent "troffers" have been around for many decades, and may be the most common commercial linear light fixtures in the world. Due to their simple construction, high volume, market competition and long history, they may be one of the lowest cost and practical light fixtures available. The prismatic lenses may come in several different prismatic feature styles such as A19 or A12, and due their simple construction, high volume, market competition etc., they may be extremely low cost, and may represent the lowest cost lens option available.

There may now be a transition in the lighting industry from fluorescent light sources to LED light sources. An obvious cost effective and practical design choice would be to simply use the existing light fixtures and prismatic lenses as described, and retrofit the fluorescent tubes with linear LED strips. However, there are problems associated with simply switching the light source. Example embodiments of the disclosed technology may address some or all of these problems.

Linear LED arrays may currently present the most economical choice for light fixtures utilizing LED light sources. They may cost significantly less than LED panel style arrays, yielding a significantly lower lumen output per dollar of cost. However, when LED arrays are simply substituted for fluorescent tubes as described, the following problems may occur:

A) Clear prismatic lenses may have insufficient diffusion and shielding properties that may allow individual LEDs to be visible, which may be visually unacceptable.

B) The light from LED sources may be directional, as compared to an omni-directional fluorescent light source, which may cause light to be poorly distributed within a light fixture, causing unacceptable bright/dark contrast on the lens. The net result may be an excessively bright area directly above the LED arrays, and relatively dark areas on the rest of the lens surface.

C) Poor color mixing of the LEDs which may exhibit objectionable color banding on the lens, especially when viewed off-axis.

D) The wire tray compartment that may typically run down the center of a light fixture may create a hard and objectionable shadow on the lens surface when viewed off axis, which may be due to direct undiffused light from the LED arrays striking the wire tray.

When frosted prismatic lenses that contain diffusion particles within their substrates, or prismatic lenses with diffusion film overlays are used to address the problems as described, they may sufficiently diffuse the light source to create acceptable lamp hiding. However, light distribution with the fixture may still not be acceptable for many applications, the hard shadow from the wire tray may still be significant, and color banding on the lens may still be visible. Additionally, frosted prismatic lenses may cost significantly more than clear prismatic lenses.

White solid (non-prismatic) diffusion lenses may effectively eliminate the problems as described, however typical white high diffusion lenses may create high losses with respect to luminaire efficiency, and may cost significantly more than clear prismatic lenses.

Example embodiments may be subsequently described that may effectively address the problems previous described, and have a desirably low manufacturing cost.

Figure 15A:
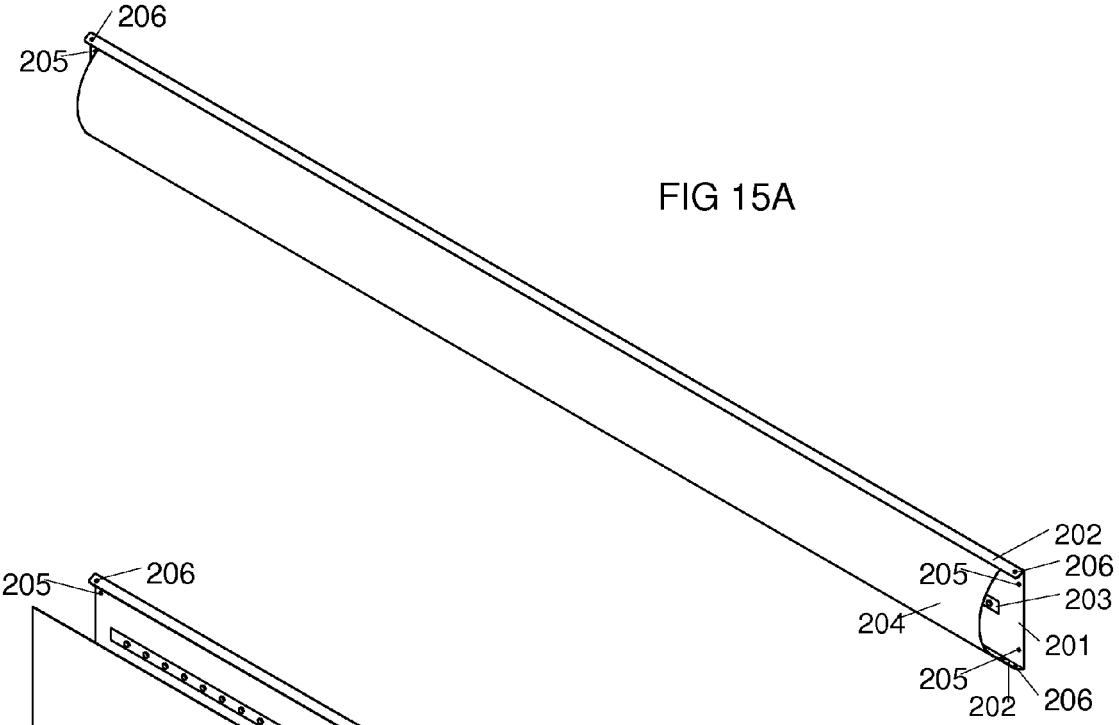
FIG. 15A depicts a perspective view of an example embodiment of light module and inner lens system with linear LED array.
Figure 15B:
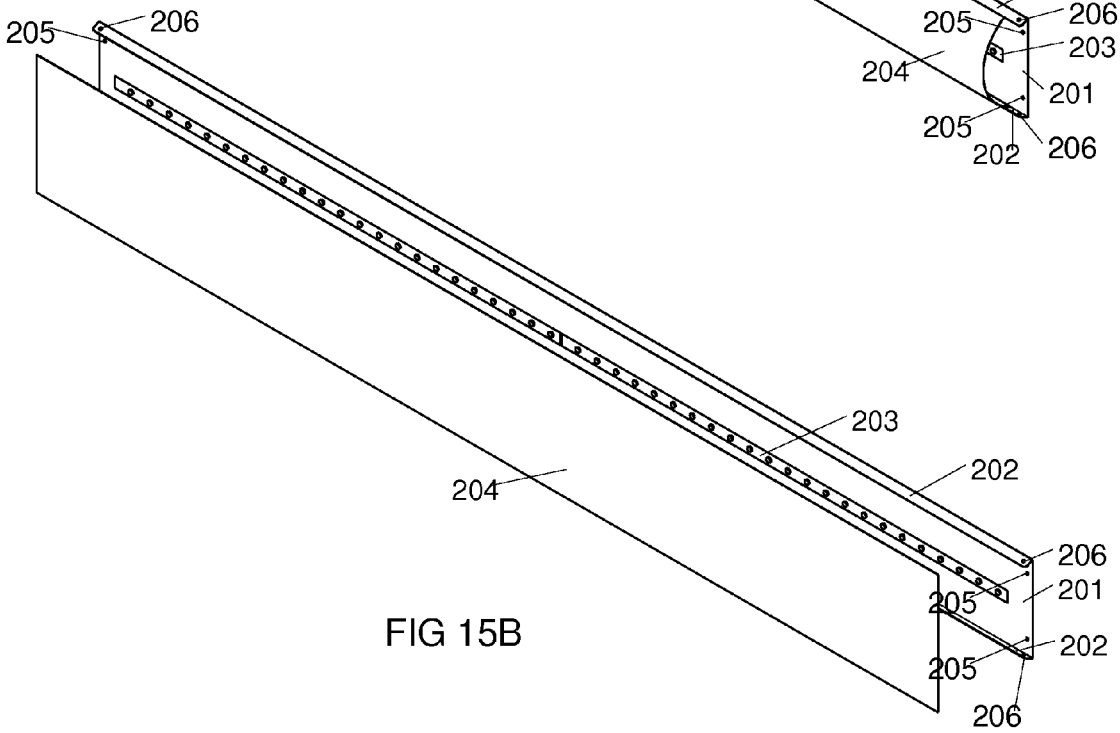
FIG. 15B depicts an exploded perspective view of an example embodiment of light module and inner lens system with linear LED array as shown in FIG. 15A.

FIG. 15A may show a perspective view, and FIG. 15B may show a perspective exploded view of an example embodiment of lighting module and Inner Lens System "ILS". A base 201 may be fabricated by sheet metal forming or stamping, extruding, or any other method of fabrication that may be cost effective. Aluminum may be preferable due to its low cost, low weight, and good thermal conductivity with respect to heat dissipation of LED arrays, although any metal or material (such as thermally conductive plastics) may be utilized that may have the required thermal and mechanical properties. Although the dimensions may be varied for different applications and different requirements, an example embodiment as shown may have approximate dimensions of 3" wide and 44" long, which may be of a suitable dimension for a standard 4'×2' troffer. The base 201 may include lens-retaining flanges 202 on two opposing edges. Referring to FIG. 16B, the lens retaining flanges 202 may be angled inwards at an appropriate angle to conform to the curvature of the curved lens 204. In this example embodiment, lens retaining flanges of approximately ⅜" may be sufficient, although any dimension may be utilized that may function to adequately secure the lens to the base for a given application. Base 201 may be painted white such as with high efficiency reflective paint for example, may be configured without paint, or may be configured with a mill finish or anodized surface finish for example. The surface treatment chosen may be a design choice. A high efficiency reflective coating may also be added to the surface of the base, such as White Optics White 97 reflective film for example.

Referring to FIG. 15B, an example embodiment of lighting module and ILS may include an LED array 203 attached to the base 201, or an example embodiment of lighting module and ILS may not include any LED array, wherein an LED array may be attached to the base during a retrofit installation. When included, the LED array 203 may be mounted in a central portion of the base 201. The LED array 203 may be screwed onto the base 201, or attached with thermal adhesive, or any other acceptable method of attachment. This method may allow a lower manufacturing cost and shorter assembly time.

Referring to FIG. 16A, a lens 204 may be a flat piece of optical film. Optical film may comprise any flat light modifying substrate that has enough flexibility to form a curved shape without breaking when compressed to the degree necessary for use as a lens material in an example embodiment. The optical film may be of any type described in related applications, for example, diffusion film. The level of diffusion of the optical film may be adjusted to the required balance of increased diffusion vs light transmission. It may be preferable in many applications to use optical film with lighter diffusion properties in order to maximize fixture efficiency. The dimensions of the flat film piece 204 may be selected to give the required curvature of the lens when compressed and installed on the base 201 as shown in FIG. 16B. In an example embodiment as previously described in FIG. 15A, a flat film piece 44"×5" may be suitable. When the long edges of the film 204 are compressed as shown by the directional arrows, and the compressed film edges are inserted inside and between the lens retaining flanges 202 (FIG. 16B), the film 204 may be disposed in curved shape as shown in FIG. 16B and become lens 204. The LED array 203 is also shown mounted on base 201.

Referring to FIG. 15B, the lens-retaining flanges 202 may optionally have holes 206 at both ends, wherein plastic rivets or any other suitable fastener may be inserted through the holes 206 and into corresponding holes in the lens 204, which may serve to further secure the lens 204 onto the base 201.

In an example embodiment, the assembled light module as shown in FIG. 15A may be retrofitted into an existing light fixture by appropriately aligning and fastening the module to the interior with screws or other fasteners through holes 205 (FIG. 15B).

In an example embodiment of light module and ILS retrofitted in a troffer with a clear prismatic lens, visually acceptable lamp hiding and light distribution within the fixture may be realized. Shadowing from the wire tray and color banding may be virtually eliminated. Tests have shown that certain optical diffusion films with relatively high light transmission characteristics utilized in a troffer with a clear prismatic A12 lens may not only eliminate the problems as described, but also may create a luminaire efficiency similar to, or better than the same fixture and LED light source with a standard medium frosted A12 prismatic lens.

An example embodiment as described IN FIG. 15A may have an advantage of functioning as a "universal" light module, wherein the light module may be directly retrofitted into light fixtures during manufacturing or on location to replace fluorescent tubes, without the need to make any significant changes to the light fixture or lens assembly. Since light fixture manufacturing may be extremely high volume and low margin, many companies may spend large sums of money on tooling and automation in order to achieve the lowest production costs. Accordingly, light fixtures that may utilize an example embodiment of light module and ILS may have advantages of cost savings on tooling and automation. These advantages as described may also be of significant advantage in the light fixture retrofit market. In many situations where fluorescent troffers are already installed, the user may wish to benefit from the energy saving and "green" aspects of LED lighting, but not wish to have the considerable expense of replacing the entire fixture. Example embodiments of light module and ILS may allow for a low cost retrofit conversion of existing fixtures to LED, may be able be installed quickly and easily, and may retain a light distribution and visual appearance similar to that of fluorescent tubes.

A significant advantage of example embodiments of light module and ILS may be very low manufacturing costs. When produced utilizing a high volume manufacturing method as previously described such as extrusion, the manufacturing cost of the base may be extraordinarily low. Similarly, example embodiments of optical film lenses may fabricated from a single flat piece of low cost diffusion film, creating a very low cost lens.

Figure 16C:
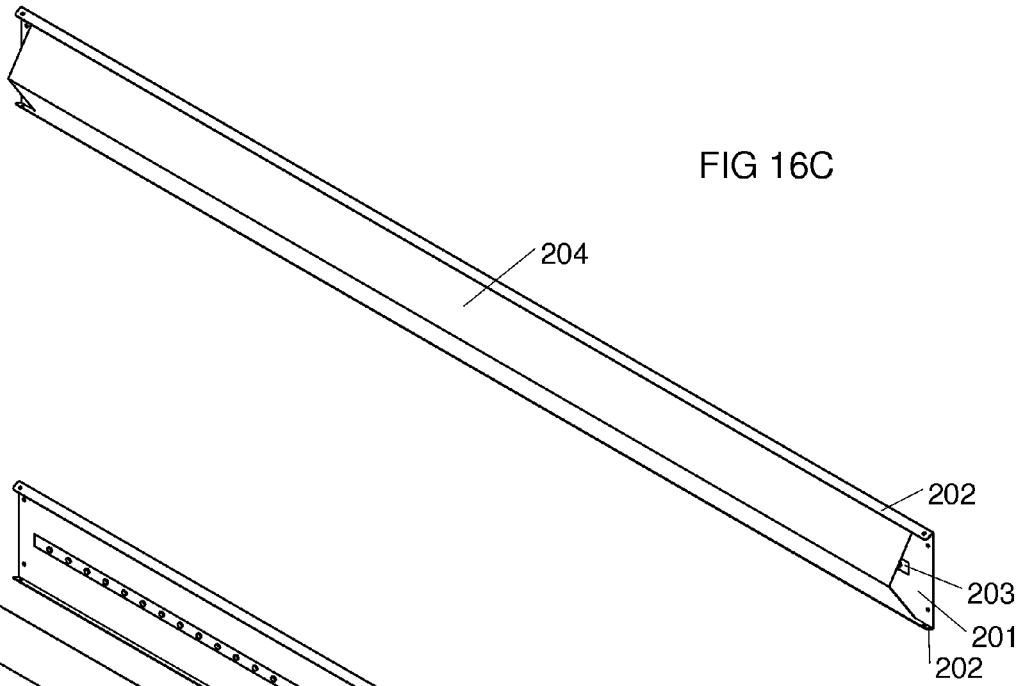
FIG. 16C depicts a perspective view of an example embodiment of light module with a bi-planar optical film piece that has been compressed and installed to form a lens.
Figure 16D:
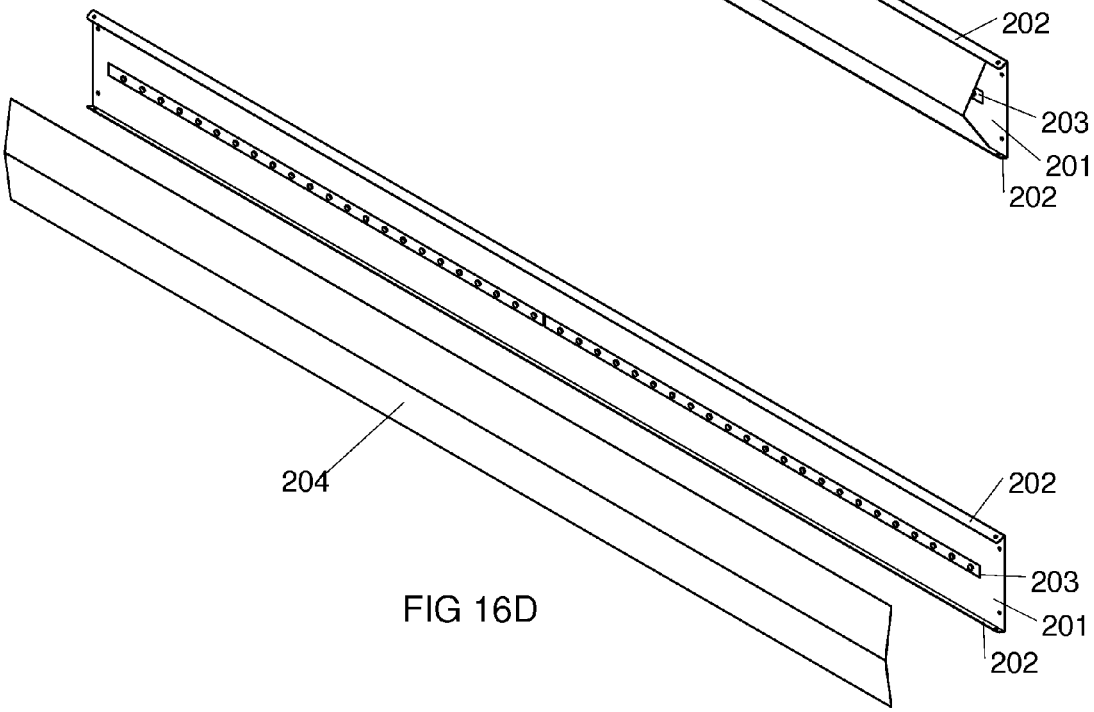
FIG. 16D depicts an exploded perspective view of the example embodiment shown in FIG. 16C.

FIG. 16C shows a perspective view, and FIG. 16D shows a perspective exploded view of an example embodiment of light module and ILS comprising a bi-planar lens. An optical film lens 204 may comprise any optical film type previously described, and may be configured in a similar manner as example embodiments of bi-planar lenses described in a related application. The long edges of the uncompressed lens 204 in FIG. 16D may be laterally compressed together, and subsequently inserted inside and between the flanges 202 on the base 201, resulting in an assembled example embodiment similar to that shown in FIG. 16C. A linear LED array 203 may be installed as previously described. The optical advantages of a bi-planar lens have been described in a related application, and will not be repeated here.

Figure 17A:
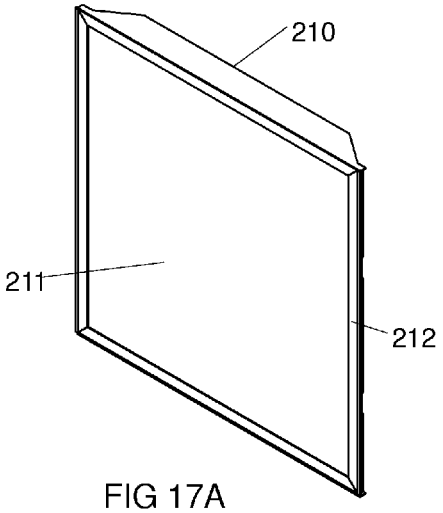
FIG. 17A shows a perspective view of an LED troffer enclosure with prismatic lens.
Figure 17B:
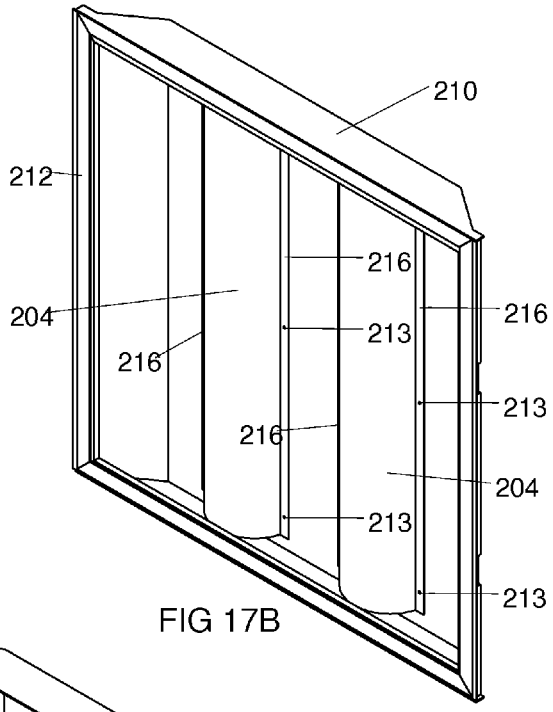
FIG. 17B shows a perspective view of an example embodiment of inner lens system in the LED troffer enclosure as shown in FIG. 17A, but with the prismatic lens removed.
Figure 17C:
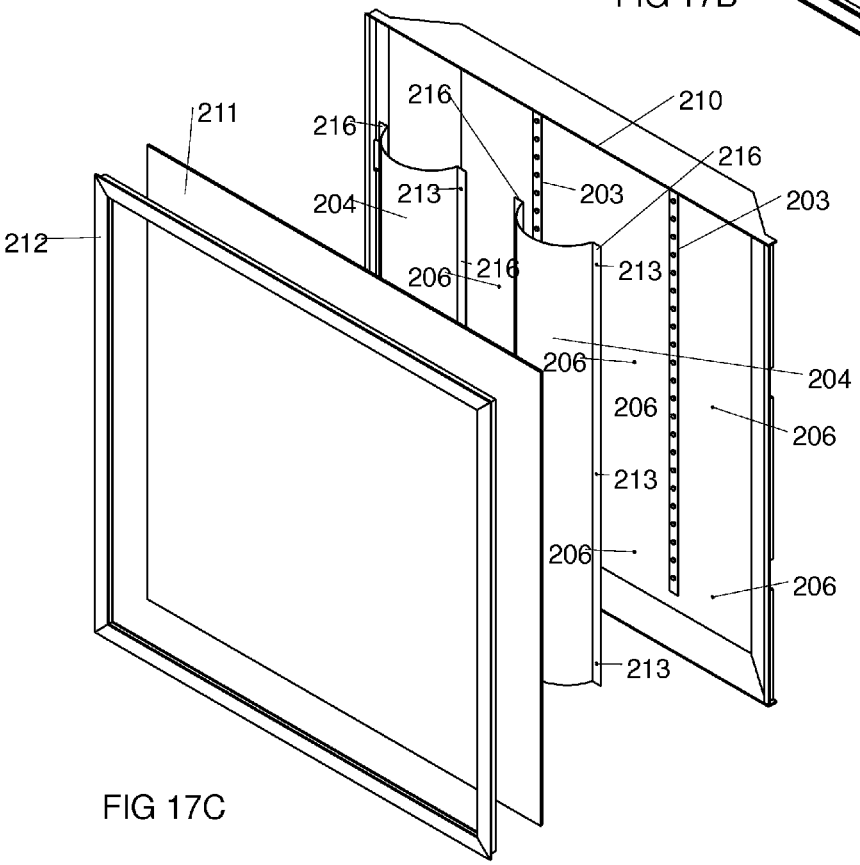
FIG. 17C shows an exploded perspective view of an example embodiment of inner lens system in an LED troffer enclosure as shown in FIG. 17B.

An example embodiment of ILS may be shown in FIGS. 17A, 17B, and 17C. FIG. 17A shows a simplified perspective view of a 2'×2' troffer light fixture 210 with a clear prismatic acrylic lens 211 mounted in doorframe 212. The same fixture may be shown in FIGS. 17B and 17C (in FIG. 17C, the prismatic lens 211 may be removed, which makes visible the inner lenses 204). FIG. 17C shows an exploded perspective view of the entire fixture. Inner lenses 204 may mount over top of LED arrays 203.

Figure 19A:
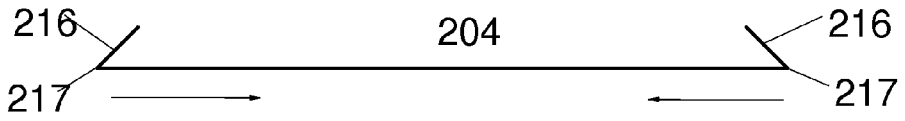
FIG. 19A shows an example embodiment of optical film inner lens in a flat uncompressed state.
Figure 19B:
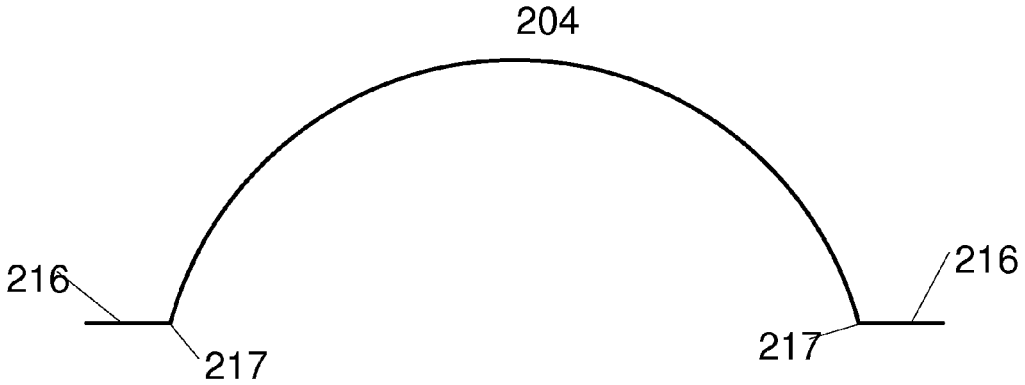
FIG. 19B shows an example embodiment of optical film inner lens in a curved compressed state.

Referring to FIG. 19A, a side view of an example embodiment of optical film lens may be shown, that may include edge trusses 216 created along folds 217. The creation of edge trusses on example embodiments of optical film lenses are described in related applications and other previously described example embodiments, and will not be repeated here. When the edges of the optical film lens 204 are compressed in the direction of the arrows, and the edge trusses 216 are secured horizontally, the shape of the lens may be somewhat similar to that as shown in FIG. 19B.

Referring to FIG. 17C, inner lenses 204 may have mounting holes 213 on edge trusses 216, through which plastic rivets (not shown), or any suitable type of fastener, may be inserted through, and fastened into corresponding holes 206 in the light fixture enclosure 210. The number of rivets required may vary by the thickness of the film used, and the degree of curvature of the inner lens 204, however the hole arrangement as shown may function to keep the inner lenses 204 disposed in an acceptable linear fashion on a 22" long lens comprising optical film approximately 120 um thick.

The functionality and optical benefits of an example embodiment of an inner lens system may be similar to that as described in an example embodiment of light module and ILS as described in FIG. 15A.

Figure 18A:
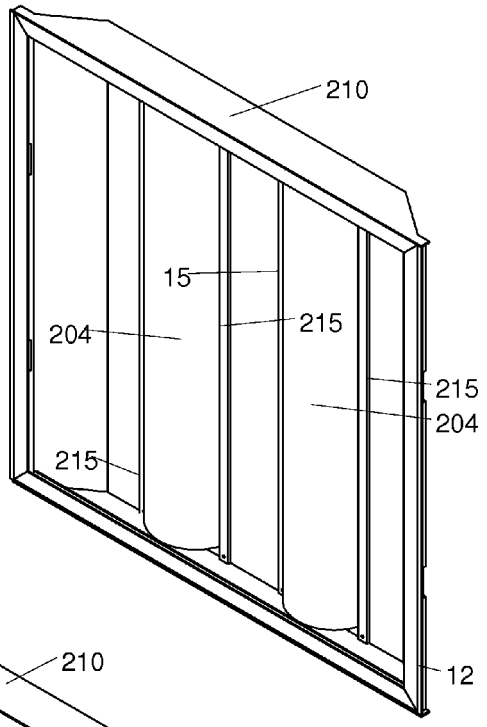
FIG. 18A shows a perspective view of an example embodiment of inner lens system in an LED troffer enclosure with the prismatic lens removed.
Figure 18B:
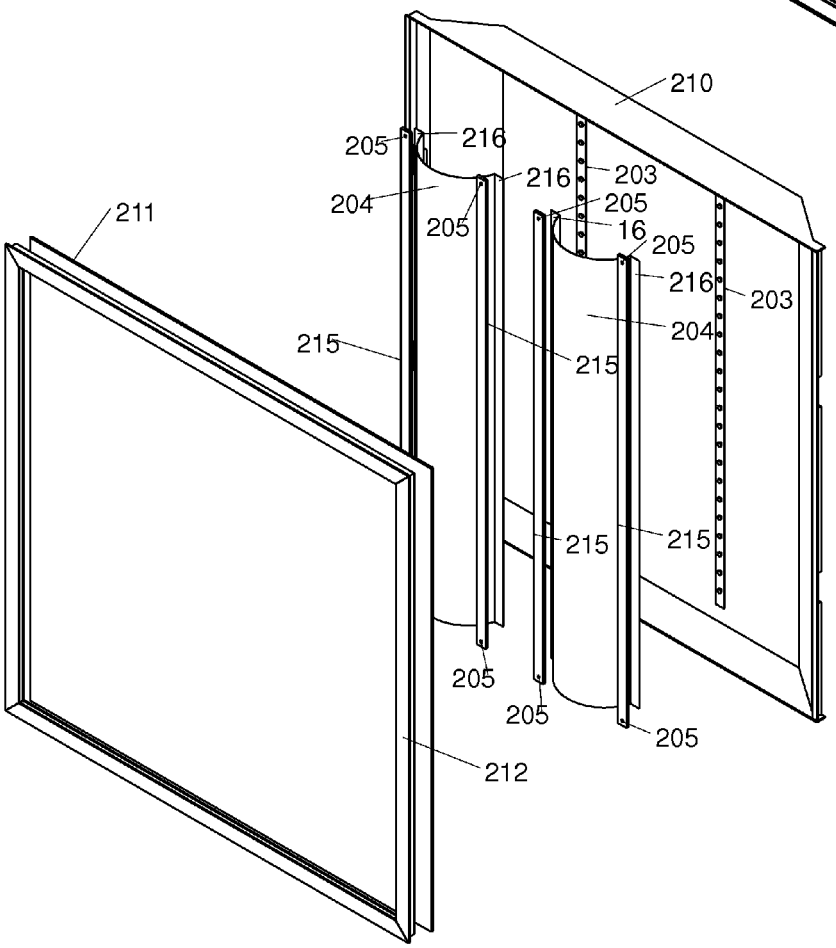
FIG. 18B shows an exploded perspective view of an example embodiment of inner lens system in an LED troffer as shown in FIG. 18A.

An example embodiment of inner lens ILS may be shown in FIGS. 18A and 18B, and may be similar to the example embodiment shown in FIG. 17B and FIG. 17C except for the method of attachment of example embodiments of ILS to the light fixture that may be different. Referring to FIG. 18A and FIG. 18B, light fixture enclosure 210 may comprise two LED arrays 203, and doorframe 212 containing lens 211. Optical film inner lens 204 may be the same as the lens previously described in FIGS. 19A and 19B. Linear strips 215 comprising any suitably rigid material may be positioned symmetrically adjacent to the LED arrays 203 and mounted to the light fixture enclosure with fasteners through holes 205 in linear strips 215, and into corresponding holes in the enclosure 210. Once the linear strips 215 are mounted, the opposing edge trusses 216 on each inner lens 204 may be inserted underneath the corresponding linear strip pairs 215, and that may function to compress the optical film into the curved shape as previously described and to hold the lenses 204 secure.

Although example embodiments of inner lens systems and light modules have been described in conjunction with troffer light fixtures and prismatic lenses, the scope of applications of alternate fixtures and lens systems should not be restricted. For example, any type of outer light fixture lens may be suitable, such as solid plastic diffuser lenses. Any light fixture or light emitting device, which utilizes a lens, may be suitable for use with example embodiments herein described.

Example embodiments of inner lens systems and light modules described herein have utilized optical film lens. However, lenses may be configured from typical traditional, cost effective diffuser materials used in commercial and residential lighting fixtures, that may for example, comprise a rigid transparent substrate such as acrylic or polycarbonate. In example implementations, any acceptable manufacturing method such as injection molding, extrusion, etc. may be utilized for producing an inner lens. According to an example implementation of the disclosed technology, the substrate of the lens may have diffusion particles dispersed within the resin itself prior to forming the lens. In another example implementation, the substrate may have a layer containing diffusion particles deposited on any of its surfaces. The lenses may be mounted on an example embodiment of light module base or directly to a light fixture enclosure utilizing methods previously described.

Example embodiments of ILS or lenses utilized in example embodiments of light module may comprise any shape that may offer optical, or manufacturing cost benefits, or advantages other than those described. For example, extruded lenses may be configured with complex curves, facets or Fresnel features.

In a first example embodiment of the technology, a light emitting device may comprise an enclosure having an inner back surface with four or more LED arrays mounted to the inner back surface of the enclosure. Each LED array may comprise a first end and a second end, an elongated rectangular shape, and one or more linear rows of LEDs. The first end or the second end of each LED array may be disposed in proximity to a first end or a second end of an adjacent LED array, wherein the four or more LED arrays may be mounted to form an acute angle of between about 60 degrees and about 120 degrees between adjacent LED arrays.

In an example embodiment, the four or more LED arrays of the first example embodiment may comprise four LED arrays mounted at an angle of about 90 degrees relative to each other, and wherein the four LED arrays may form a square shape.

In an example embodiment, the four or more LED arrays of the first example embodiment may comprise four LED arrays mounted at an approximate angle of 90 degrees relative to each other, and wherein the four LED arrays form a rectangular shape.

In an example embodiment, the four or more LED arrays of the first example embodiment may comprise six LED arrays mounted at an angle of about 120 degrees relative to each other, and wherein the six LED arrays form a hexagonal shape.

In a second example embodiment, a lens assembly may comprise a lens element configured to modify light from a light source, and one or more lens-partitioning elements disposed on at least one surface of the lens element. The one or more lens-partitioning elements may comprise one or more pieces of optical film or one or more layers or groupings of particles, wherein the one or more pieces of optical film or the one or more layers or groupings of particles may be arranged in a two-dimensional geometric shape on the lens element.

In an example embodiment, the lens assembly of the second example embodiment may be configured for attaching to a light fixture that includes a light source. A portion of the at least one of the one or more lens-partitioning elements may comprise one or more pieces of optical film or one or more layers or groupings of particles configured to be co-aligned with the light source in at least one dimension.

In an example embodiment, the lens assembly of the second example embodiment may be configured for attaching to a light fixture that includes a light source. At least one of the one or more lens-partitioning elements may comprise one or more pieces of optical film or one or more layers or groupings of particles that may be configured to be disposed adjacent to the light source and offset from the light source in at least two dimensions.

In an example embodiment, the one or more lens-partitioning elements of the second example embodiment may comprise one or more pieces of optical film or one or more layers or groupings of particles attached to a central area of a surface of the lens assembly.

In an example embodiment, the one or more lens-partitioning elements of the second example embodiment may comprise one or more pieces of optical film or one or more layers or groupings of particles attached to the surface of the lens assembly along all or a portion of outer edges of the lens element.

In an example embodiment, the one or more lens-partitioning elements of the second example embodiment may comprise one or more pieces of optical film that includes linear refraction features or textures disposed on one or both sides.

In an example embodiment, the one or more lens-partitioning elements of the second example embodiment may comprise one or more layers or groupings of particles applied to one or more surfaces of the lens assembly utilizing a printing method or a printing process.

In an example third implementation of the disclosed technology, a compression lens assembly may comprise at least one piece of optical film. The at least one piece of optical film may comprise a left edge defining a Y-axis, a right edge that is substantially parallel to the left edge, a top edge defining a X-axis and having an uncompressed edge length UEL, a bottom edge that is substantially parallel to the top edge and having an uncompressed edge length about UEL. The at least one piece of optical film may further comprise a Z-axis that is perpendicular to the X-axis and the Y-axis, a top light-emitting side and a bottom light-receiving side, and one or more inward folds and or one or more outward folds extending from the top edge to the bottom edge, wherein the one or more folds may be substantially parallel to one or more of the left edge and the right edge.

In an example embodiment, a compression lens assembly may comprise an edge truss on each of the left edge and the right edge, wherein each edge truss may comprise at least one truss side configured from a corresponding fold in the at least one piece of optical film. The at least one truss side of each of each edge truss may be configured at an angle relative to the top light emitting side of the at least one piece of optical film and may be configured to resist deflection of each edge truss.

In an example embodiment, the compression lens assembly of the third example embodiment may comprise a lens containment feature that may comprise a top channel and a bottom channel having channel lengths CL smaller than the uncompressed edge length UEL of the top and bottom edges of the at least one piece of optical film. The top channel and bottom channel may be configured to engagingly secure and restrict movement of the corresponding top and bottom edges of the at least one piece of optical film in at least the Z-axis direction.

In an example embodiment, the compression lens assembly of the third example embodiment may comprise a lens containment feature that may comprise a left channel and a right channel configured to slidingly accept in a Y-axis direction at least a portion of the at least one piece of optical film at the corresponding left and right edges, and to engagingly restrict movement and to compress in an X-axis direction at least a portion of the at least one piece of optical film. The at least one piece of optical film under compression may form one or more hill or valley profiles between adjacent folds.

In an example embodiment, the compression lens assembly of the third example embodiment may further comprise a lens containment feature that comprises a light fixture doorframe.

In an example embodiment, the compression lens assembly of the third example embodiment may further comprise a lens containment feature that comprises channels in a light fixture enclosure.

In an example embodiment, the compression lens assembly of the third example embodiment may comprise one or more pieces of optical film that may comprise one or more folds that may comprise N folds, resulting in N+1 hill or valley profile sections joined at the N folds in the at least one piece of optical film.

In an example embodiment, the one or more inward folds of the third example embodiment may be defined by folds with peaks disposed on the top light-emitting side of the at least one piece of optical film. The one or more outward folds may be defined by folds with peaks disposed on the bottom light-receiving side of the at least one piece of optical film, and wherein the one or more inward folds and or one or more outward folds may comprise five inward folds resulting in five hills and four valleys.

In an example embodiment, the one or more inward folds of the third example embodiment may be defined by folds with peaks disposed on the top light-emitting side of the at least one piece of optical film. The one or more outward folds may be defined by folds with peaks disposed on the bottom light-receiving side of the at least one piece of optical film, and wherein the one or more inward folds and or one or more outward folds may comprise four inward folds resulting in four hills and three valleys.

In an example embodiment, the one or more inward folds of the third example embodiment may be defined by folds with peaks disposed on the top light-emitting side of the at least one piece of optical film. The one or more outward folds may be defined by folds with peaks disposed on the bottom light-receiving side of the at least one piece of optical film, wherein the one or more inward folds and or one or more outward folds may comprise two pairs of outward folds resulting in a rounded hill profile between each pair of outward folds, one center inward fold resulting in a center hill, and one inward fold on the left and right edge of the at least one piece of optical film resulting in hills on each edge.

In a fourth example embodiment, a retrofit lighting module may comprise an elongated rectangular piece of thermally conductive material comprising two long edges separated by a width W1, two short edges, and a front surface. Each long edge may comprise a mounting flange extending along all or a substantial portion of the length of the edge, and wherein each mounting flange may form an angle of less than about 90 degrees with the front surface. The retrofit lighting module may further comprise an elongated rectangular piece of optical film having width W2 that is greater than width W1. The piece of optical film may comprise two short film edges and two long film edges, wherein the optical film piece may be configured to form a curved lens when the two long film edges are compressed towards each other and inserted into and between the corresponding flanges on the elongated rectangular piece of thermally conductive material. The front surface of the thermally conductive piece may be configured for attachment to one or more linear LED arrays and the retrofit lighting module may be configured to retrofit into a lighting fixture.

In an example embodiment, the retrofit lighting module of the fourth example embodiment may further comprise one or more linear LED arrays disposed on the front surface of the thermally conductive material.

In an example embodiment, the retrofit lighting module of the fourth example embodiment may further comprise a fold in a central region between, and substantially parallel to the two long film edges, wherein the fold may be configured to form a bi-planar lens profile in the optical film piece.

While certain implementations of the disclosed technology have been described in connection with what is presently considered to be the most practical and various implementations, it is to be understood that the disclosed technology is not to be limited to the disclosed implementations, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain implementations of the disclosed technology, including the best mode, and also to enable any person skilled in the art to practice certain implementations of the disclosed technology, including making and using any devices or systems and performing any incorporated methods. The patentable scope of certain implementations of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A compression lens assembly comprising:

at least one piece of optical film comprising:

a left edge defining a Y-axis;

a right edge that is substantially parallel to the left edge;

a top edge defining a X-axis and having an uncompressed edge length UEL;

a bottom edge that is substantially parallel to the top edge, and having an uncompressed edge length about UEL;

a Z-axis that is perpendicular to the X-axis and the Y-axis;

a top light-emitting side and a bottom light-receiving side;

one or more inward folds and or one or more outward folds extending from the top edge to the bottom edge, wherein the one or more folds are substantially parallel to one or more of the left edge and the right edge;

an edge truss on each of the left edge and the right edge, wherein each edge truss comprises at least one truss side configured from a corresponding fold in the at least one piece of optical film, wherein the at least one truss side of each of each edge truss is configured at an angle relative to the top light emitting side of the at least one piece of optical film and is configured to resist deflection of each edge truss;

a lens containment feature comprising:

a top channel and a bottom channel having channel lengths CL smaller than the uncompressed edge length UEL of the top and bottom edges of the at least one piece of optical film, the top channel and bottom channel configured to engagingly secure and restrict movement of the corresponding top and bottom edges of the at least one piece of optical film in at least the Z-axis direction;

a left channel and a right channel configured to slidingly accept in a Y-axis direction at least a portion of the at least one piece of optical film at the corresponding left and right edges, and to engagingly restrict movement and to compress in an X-axis direction at least a portion of the at least one piece of optical film, and wherein the at least one piece of optical film under compression forms one or more hill or valley profiles between adjacent folds.

2. The compression lens assembly of claim 1, wherein the lens containment feature is a light fixture doorframe.

3. The compression lens assembly of claim 1, wherein the lens containment feature comprises channels in a light fixture enclosure.

4. The compression lens assembly of claim 1, wherein the one or more folds comprise N folds resulting in N+1 hill or valley profile sections joined at the N folds in the at least one piece of optical film.

5. The compression lens assembly of claim 1, wherein the one or more inward folds are defined by folds with peaks disposed on the top light-emitting side of the at least one piece of optical film, and the one or more outward folds are defined by folds with peaks disposed on the bottom light-receiving side of the at least one piece of optical film, and wherein one or more of the one or more inward folds and the one or more outward folds comprise five inward folds resulting in five hills and four valleys.

6. The compression lens assembly of claim 1, wherein the one or more inward folds are defined by folds with peaks disposed on the top light-emitting side of the at least one piece of optical film, and the one or more outward folds are defined by folds with peaks disposed on the bottom light-receiving side of the at least one piece of optical film, and wherein one or more of the one or more inward folds and the one or more outward folds comprise four inward folds resulting in four hills and three valleys.

7. The compression lens assembly of claim 1, wherein the one or more inward folds are defined by folds with peaks disposed on the top light-emitting side of the at least one piece of optical film, and the one or more outward folds are defined by folds with peaks disposed on the bottom light-receiving side of the at least one piece of optical film, and wherein the one or more inward folds and or one or more outward folds comprises two pairs of outward folds resulting in a rounded hill profile between each pair of outward folds, one center inward fold resulting in a center hill, and one inward fold on the left and right edge of the at least one piece of optical film resulting in hills on each edge.

8. A compression lens assembly comprising:

an elongated rectangular piece of material comprising:

two long edges separated by a width W1, and two short edges;

a front surface; and a mounting flange extending along all or a substantial portion of the length of each long edge, wherein each mounting flange comprises a substantially flat inner surface that forms an angle of less than about 90 degrees relative to the front surface;

an elongated rectangular piece of optical film comprising:

two short major film edges and two long major film edges, wherein each long major film edges comprises an adjacent major first surface configured for engagement and retention by corresponding substantially flat inner surfaces of the mounting flanges, wherein each major first surface or long major film edge does not require one or more of folds and bulges in order to be engaged and retained by the corresponding substantially flat inner surfaces of the mounting flanges; and a width W2 that is greater than width W1;

wherein the piece of optical film forms a curved lens when the two long major film edges are compressed towards each other and inserted between corresponding flanges on the elongated rectangular piece of material such that each major first surface of the elongated rectangular piece of optical film are engaged and retained by the corresponding substantially flat inner surfaces of the mounting flanges.

9. The compression lens assembly of claim 8, wherein the piece of optical film forms a curved lens when the two long major film edges are compressed towards each other and disposed between the corresponding flanges on the elongated rectangular piece of material.

10. The compression lens assembly of claim 8, wherein the elongated rectangular piece of material comprises a thermally conductive material.

11. The compression lens assembly of claim 8 further comprises one or more linear LED arrays mounted on, or in proximity to the front surface of the elongated rectangular piece of material.

12. The compression lens assembly of claim 8 is an LED retrofit lighting module configured to retrofit into a lighting fixture.

13. The compression lens assembly of claim 8, wherein the piece of optical film further comprises a fold in a central region between and substantially parallel to the two long major film edges, the fold configured to form a bi-planar lens profile in the piece of optical film.

14. The compression lens assembly of claim 8, wherein the elongated rectangular piece of optical film further comprises one or more edge trusses on each long major film edge, wherein the one or more edge trusses are configured from one or more folds in the elongated rectangular piece of optical film.

15. A compression lens assembly comprising:

a light reflecting surface; and an elongated support structure disposed above the reflecting surface, the elongated support structure comprising a bottom side that faces the light reflecting surface, and at least one of either a channel, slot, or groove, wherein the minimum distance between the at least one channel, slot or groove and the light reflecting surface is distance X; and at least one optical film piece comprising a light-receiving side, a light-emitting side, at least one attachment edge, and at least one fold or crease that is substantially parallel to the at least one attachment edge, wherein the distance between the at least one crease or fold and the attachment edge is greater than distance X, and the portion of the at least one optical film piece between the at least one crease or fold and attachment edge defines a lens section;

wherein the attachment edge of the optical film is configured for engagement in the at least one channel, slot or groove, and the at least one fold or crease is configured to contact the light reflecting surface wherein compression of the lens section forms a curved lens section.

16. The compression lens assembly of claim 15, wherein the attachment edge of the optical film engages in the at least one channel, slot or groove, and the at least one fold or crease contacts the light reflecting surface, wherein compression of the lens section forms a curved lens section.

17. The compression lens assembly of claim 15, wherein the at least one channel, slot, or groove comprises two opposing one or more of channels, slots, or grooves, and the at least one optical film piece comprises two pieces of optical film, wherein each piece of optical film comprises a light-receiving side, a light-emitting side, at least one attachment edge, and at least one fold or crease that is substantially parallel to the at least one attachment edge, wherein the distance between the at least one crease or fold and attachment edge is greater than distance X, and the portion of the at each optical film piece between the at least one crease or fold and attachment edge defines a lens section;

wherein the attachment edge of each optical film piece engages an opposing channel, slot or groove of the elongated support structure, and each at least one fold or crease contacts the light reflecting surface wherein compression of each lens section forms respective curved lens sections.

18. The compression lens assembly of claim 17, wherein the elongated support structure includes one or more linear LED arrays attached on, or in close proximity to the bottom side of the elongated support structure, wherein the light emitting side of the one or more linear LED arrays faces the light reflecting surface, and wherein the light-receiving side of each optical film piece faces the one or more linear LED arrays.

19. The compression lens assembly of claim 17, wherein a portion of each optical film piece covers a portion of the light reflecting surface.

20. The compression lens assembly of claim 15, wherein a portion of the at least one optical film piece covers a portion of the light reflecting surface.

* * * * *